US006034033A

United States Patent [19]

Aono et al.

[11] Patent Number: 6,034,033

[45] Date of Patent: Mar. 7, 2000

[54] HEAT-SENSITIVE RECORDING MATERIAL

[75] Inventors: Toshiaki Aono, Kanagawa; Yuichi Wakata; Shigetoshi Ono, both of Shizuoka-ken, all of Japan

[73] Assignee: Fuji Photo Film Co., Ltd., Kanagawa, Japan

[21] Appl. No.: 09/009,153

[22] Filed: Jan. 20, 1998

[30] Foreign Application Priority Data

| | | | |
|---|---|---|---|
| Jan. 17, 1997 | [JP] | Japan | 9-007060 |
| Apr. 1, 1997 | [JP] | Japan | 9-083052 |
| Oct. 9, 1997 | [JP] | Japan | 9-277702 |

[51] Int. Cl.[7] ..... B41M 5/035

[52] U.S. Cl. ..... 503/200; 427/152; 503/226

[58] Field of Search ..... 427/152; 503/200, 503/226

[56] References Cited

U.S. PATENT DOCUMENTS

| | | | |
|---|---|---|---|
| 5,401,708 | 3/1995 | Shimizu et al. | 503/226 |
| 5,679,615 | 10/1997 | Matsumoto et al. | 503/217 |
| 5,866,508 | 2/1999 | Sawamura et al. | 503/226 |

FOREIGN PATENT DOCUMENTS

| | | | |
|---|---|---|---|
| 4-175309 | 6/1992 | Japan | 503/226 |
| 6-72042 | 3/1994 | Japan | 503/226 |
| 6-247048 | 9/1994 | Japan | 503/226 |
| 7-290822 | 11/1995 | Japan | 503/226 |
| 8-290662 | 11/1996 | Japan | 503/226 |

*Primary Examiner*—Bruce H. Hess
*Attorney, Agent, or Firm*—Sughrue, Mion, Zinn, Macpeak & Seas, PLLC

[57] ABSTRACT

A heat sensitive recording material comprising a substrate having sequentially thereon a heat sensitive recording layer and a protective layer, 1) wherein the protective layer contains an aqueous silicone modified polymer.

It is desirable this aqueous silicone modified polymer is used together with an aqueous binder, and a crosslinking agent which can cause a crosslinking reaction with them is desirably used. 2) The protective layer contains a silicone modified polymer having a Tg (glass transition point) of 60° C. or more. In the heat sensitive recording materials of 1) and 2), the silicone modified polymer is desirably a silicone graft polymer, silicone block polymer, silicone modified acrylic polymer and the like, and particularly, the silicone graft polymer is desirably a silicone graft acrylic polymer and the like.

19 Claims, No Drawings

HEAT-SENSITIVE RECORDING MATERIAL

BACKGROUND OF THE INVENTION

1. Field of the Invention

The present invention relates to a heat sensitive recording material, and more particularly, to a heat sensitive recording material, comprising a substrate having thereon a heat sensitive recording layer and a protective layer, which protective layer is excellent in transparency, gloss, heat resistance, and light fastness and simultaneously excellent in sliding properties and lubricating properties, which does not cause adhesion and trash deposition on a thermal head and the like and provides excellent color-developed images.

2. Description of the Related Art

Heat sensitive recording has recently begun to expand due to the recording apparatus used being simple, having high reliability, and requiring no maintenance. As the heat sensitive recording material used in this method, a material which utilizes a reaction of an electron donative colorless dye with an electron acceptive compound, a material which utilizes a reaction of a diazonium salt compound with a coupler, and the like are conventionally widely known.

Recently, intense research has been carried out to try and improve characterictics such as (1) color developing density and color developing sensitivity, (2) the fastness of a color developed material, and the like, of heat sensitive recording materials. However, when the heat sensitive recording material is exposed to sunlight for a long period of time, or is displayed in an office or the like for a long period of time, the background region of the heat sensitive recording material becomes colored and the image region changes or loses its color. Various methods have been suggested for improving this coloring of the background region and the changes in or loss of color in the image region of the heat sensitive recording material, however, satisfactory results have not always been obtained.

On the other hand, demands for a heat sensitive recording system have been expanded in a number of fields such as for facsimiles, printers, labels and the like. At the same time, friction resistance between the heat sensitive recording paper and the heat sensitive recording head, friction resistance in the rear surface of the paper, and the like are required. Conventionally, waxes (for example, zinc stearate and the like), matting agents, pigments and the like are used for imparting lubricating properties and friction resistance to a heat sensitive recording material. However, when these means are used, the friction resistance and lubricating properties are not always satisfactory, further, the transparency and gloss of a heat sensitive recording material are reduced, and these components are fused to the thermal head and the like to cause trash deposition, gloss unevenness and the like.

SUMMARY OF THE INVENTION

An object of the present invention is to provide a heat sensitive recording material comprising a protective layer which is excellent in transparency, gloss, heat resistance and light resistance and simultaneously has excellent sliding properties and lubricating properties, which does not cause adhesion and trash deposition on the thermal head and the like and provides excellent color-developed images.

In order to accomplish the above-described object, the heat sensitive recording material of the present invention, is a heat sensitive recording material comprising a substrate having a heat sensitive recording layer and a protective layer provided sequentially thereon, wherein said protective layer is formed using at least an aqueous silicone modified polymer.

This heat sensitive recording material is desirably one formed by using at least an aqueous silicone modified polymer and an aqueous binder, and more desirably one in which crosslinking is formed by using an aqueous silicone modified polymer and/or an aqueous binder and a crosslinking agent which can cause a crosslinking reaction. It is desirable that the aqueous silicone modified polymer and/or aqueous binder has as a functional group at least one functional group selected from a group consisting of a carboxyl group (or salt thereof), an amino group, an ammonium salt group, an hydroxyl group, a sulfinic acid group (or salt thereof), a sulfonic acid group (or salt thereof), and a glycidyl group.

Further, the heat sensitive recording material of the present invention, for accomplishing the above-described object, is a heat sensitive recording material comprising a substrate having a heat sensitive recording layer and a protective layer provided sequentially thereon, wherein said protective layer contains a silicone modified polymer having a Tg (glass transition point) of 60° C. or more.

This silicone-modified polymer has a Tg (glass transition point) of preferably 80° C or more, and more preferably of 100° C. or more.

Further, the heat sensitive recording layer desirably has at least one layer comprising as a main component a diazo compound, a coupler which effects a coupling reaction with said diazo compound, and a binder.

When the aforementioned protective layer is formed by an aqueous silicone modified polymer and aqueous binder, this aqueous binder is preferably a water-soluble polymer or an aqueous latex, and the water-soluble polymer may advantageously be a water-soluble polymer which can be set-dried. The water-soluble polymer which can be set-dried is desirably composed of at least one selected from the group consisting of gelatin or derivative thereof, K-carageenan, and polyvinyl alcohol or derivative thereof. Particularly, it is desirable that polyvinyl alcohol is used together with boric acid or salt thereof, or polyvinyl alcohol and x-carageenan are used together.

It is particularly suitable that the silicone modified polymer of the present invention is a silicone graft polymer or silicone block polymer.

DESCRIPTION OF THE PREFERRED EMBODIMENTS

The preferred embodiments of the heat sensitive recording material of the present invention will be described below.

The heat sensitive recording material of the present invention is a heat sensitive recording material comprising a substrate having sequentially thereon a heat sensitive recording layer and a protective layer, and this protective layer is one formed using at least an aqueous silicone modified polymer. As the aqueous silicone modified polymer, a silicone graft polymer, silicone block polymer, silicone modified acrylic polymer, silicone modified polyvinyl alcohol and the like are preferred. As the silicone graft polymer, a silicone graft acrylic polymer and silicone graft modified polyvinyl alcohol are preferred, and as the silicone block polymer, a silicone block acrylic polymer and silicone block modified polyvinyl alcohol are preferred.

The skeletal polymer in the silicone modified polymer may be any resin provided it is a resin having excellent film forming properties, heat resistance, and light resistance and having a Tg(glass transition point) showing a high film strength, and an acrylic resin and polyvinyl alcohol based resin are particularly preferably used.

Examples of the monomer constituting this acrylic resin include acrylic monomers such as methyl (meth)acrylate, butyl (meth)acrylate, 2-ethylhexyl (meth) acrylate, glycidyl (meth)acrylate and the like. Further, copolymerizable monomers other than acrylic monomers, such as styrene, acrylonitrile, vinyl acetate, N-vinylpyrrolidone, N-t-butylacrylamide and the like may also be copolymerized.

Further, it is preferred that a monomer such as (meth) acrylic acid (or salt thereof), maleic acid (or salt thereof), itaconic acid (or salt thereof), styrenesulfonic acid (or salt thereof), 2-acrylamide-2-methylpropanesulfonic acid (or salt thereof), 2-hydroxyethyl (meth)acrylate, acrylamide, dimethylacrylamide, dimethylaminoethyl (meth)acrylate (or salt thereof), polyethylene glycol monomethyl ether mono (meth)acrylate or the like, is contained as a water-solubility imparting unit if the polymer is a water-soluble type and as a dispersion-stability imparting unit if the polymer is an emulsion type or latex type.

As the branch polymer of the silicone modified polymer, any polymer is permissible provided it is silicone, and polydimethylsiloxane is preferably used.

Polydimethylsiloxane has excellent properties in the areas of water repelling properties and lubrication properties.

Therefore, a copolymer having a unit derived from the above-described acrylic monomer and a polydimethylsiloxane unit has excellent film forming properties, heat resistance, and light resistance and also has excellent water repelling properties and lubricating properties together with a high film strength.

As the silicone modified polymer in the present invention, silicone graft polymers are preferred, and of the silicone graft polymers, copolymers composed of a silicone macro monomer and a monomer copolymerizable with the macro monomer represented by the general formula (3) are preferred, and among them, copolymers represented by the general formula (4) are particularly preferred.

General formula (3)

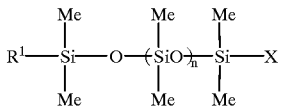

$R^1$: alkyl group having 1 to 6 carbon atoms

X: $CH{=}CH_2$, 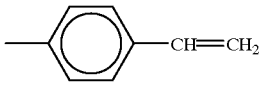 $CH{=}CH_2$

-continued

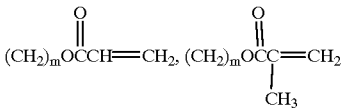

m: 2 to 6
n: positive integer
General formula (4)

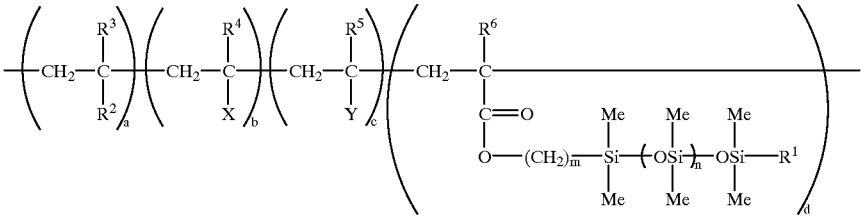

In the general formula (4), $R^1$ represents an alkyl group having 1 to 6 carbon atoms, $R^2$ represents $COOR^7$, an aryl group, a cyano group, an imidazole group, a triazole group, a pyrrolidone group, or $OCOR^7$ (wherein, $R^7$ represents an alkyl group, an aryl group or an aralkyl group), $R^3$, $R^4$, $R^5$ and $R^6$ each represent hydrogen or a methyl group, X represents a hydrophilic group, Y represents a reactive group, n represents a positive integer, m represents 2 to 6, a, b, c and d (wherein, c may be 0) each represent a polymerization degree.

Examples of the hydrophilic group (X) in the general formula (4) include a polyethylene oxide group, a polypropylene oxide group, a carboxyl (or salt thereof) group, a hydroxyl group, a sulfonic acid (or salt thereof) group, an amino group, an amide group, a substituted amide group, an ammonium salt group, and groups having these functional groups (for example, $—COOCH_2CH_2HO\ COO(CH_2CH_2O)_n\ H$), and the like.

Examples of the reactive group (Y) include a group which can react with a crosslinking agent and/or a binder, for example, an amino group, a carboxyl (or salt thereof) group, a hydroxyl group, a sulfinic acid (or salt thereof) group, a glycidyl group, and groups having these functional groups, and the like.

These silicone graft acrylic resins are produced by solution polymerization by an azobis-based compound or organic peroxide using a blended composition of monomers in, for example, an organic solvent such as isopropyl alcohol, toluene, xylene and the like, or by emulsion polymerization using potassium persulfate and the like in coexistence with nonionic, anionic, and cationic surfactants.

The silicone modified polyvinyl alcohol derivative means a polymer having repeating units (polysiloxane chain) represented by the general formula (1) and general formula (2).

General formula (1)

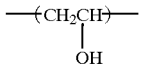

General formula (2)

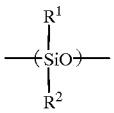

Wherein, $R^1$ and $R^2$ each represent an alkyl group having 6 or less carbon atoms or an aryl group.

As the substituent of the polysiloxane chain, a methyl group, an ethyl group, a phenyl group, and the like are listed, and polymethylsiloxane is particularly suitable in view of the availability of the raw material.

Conventionally, a polyvinyl alcohol derivative containing silicon is well known. For example, Japanese Patent Application Laid-Open (JP-A) Nos. 63-196603, 58-79003 and 58-59203 disclose a polyvinyl alcohol derivative containing silicon. Further, Japanese Patent Application Laid-Open (JP-A) Nos. 58-193189, 1-204785, 2-22646, and Japanese Patent Application Publication (JP-B) No. 4-32745 describe how such a compound is used in or on top of the heat sensitive color developing layer of a heat sensitive recording material.

However, the silicon used in any compound described in these publications, is only that having a reactive substituent such as an alkoxy group, an acyloxy group, a hydroxyl group (or an alkaline metal salt), and the like, and a polyvinyl alcohol derivative having a polysiloxane chain is not described.

Regarding the polyvinyl alcohol derivative having a polysiloxane chain, Makromol, Chem. 186(4), p685, (1985), J. Colloid. Interface, Sci. 114(1), p16, (1986), Polymer Kako (Polymer Processing), 34(11), p522, (1985) describe a method in which a copolymer composed of vinyl acetate and polydimethylsiloxane having a vinyl group is hydrolyzed to synthesize a polyvinyl alcohol derivative containing polydimethylsiloxane. However, there is no description regarding the utilization thereof for a heat sensitive recording material.

Further, Japanese Patent Application Laid-Open (JP-A) No. 63-256629 describes a method using a reaction of isocyanate group-containing polyxiloxane with an active hydrogen-containing resin, and Japanese Patent Application Laid-Open (JP-A) No. 7-292361 describes a reaction product of epoxy group-containing polysiloxane with polyvinyl alcohol. However, there is no description regarding the utilization thereof for a heat sensitive recording material.

Thus, there is used a method in which a copolymer composed of a monomer having a polysiloxane chain and vinyl acetate is hydrolyzed, or a method in which a polysiloxane compound containing a reactive functional group such as an epoxy group, an isocyanate group, carboxylic acid, carboxylic acid halide and the like, and a hydroxyl group (or a COOH group and the like which can be contained in polyvinyl alcohol as a copolymerization component) of polyvinyl alcohol (or derivative thereof) are reacted. By these synthesis methods, silicone graft polyvinyl alcohol (or derivative thereof) having as a graft chain a polysiloxane chain is obtained.

Further, silicone block polyvinyl alcohol (or derivative thereof) is obtained by radical-polymerizing a monomer containing a polysiloxane chain from a terminal end SH group of a polyvinyl alcohol derivative having an SH group on the terminal end. Such a method for synthesizing a block polymer by radical polymerization utilizing a terminal end SH group is described in Japanese Patent Application Laid-Open (JP-A) No. 59-189133, Polymer Theses, 49(11), p885, (1992), and the like. However, there is no example described for synthesizing a silicone block polyvinyl alcohol derivative using a monomer containing polysiloxane. Further, a silicone block polyvinyl alcohol (derivative) can also be obtained by adding a polysiloxane compound containing an epoxy group to a terminal end SH group of a polyvinyl alcohol derivative having an SH group on the terminal end.

As the monomer containing a polysiloxane chain used in these syntheses, for example, the above-described compounds represented by the general formula (3) are listed.

As the silicone modified polymer in the present invention, any type is permissible, selected from a water-soluble type, an emulsion type, a latex type, and a type obtained by removing a solvent during or before the preparation of a coating solution from a type dissolved in a solvent miscible with water such as alcohol and the like, or a solvent made from a mixture of these solvents with water. Of these, the water-soluble type, or the type obtained by removing a solvent during or before the preparation of a coating solution from a type dissolved in a solvent miscible with water such as alcohol and the like, or a solvent made from a mixture of these solvents with water, is preferred. When these are included in the protective layer, another water-soluble binder is usually used as well.

The silicone modified polymers have a Tg (glass transition point) of 60° C. or more, preferably 80° C. or more, and more preferably 100° C. or more. When the silicone modified polymers have a Tg (glass transition point) of less than 60° C., the lubrication of the head during printing is reduced and is therefore not preferable.

It is desirable that a crosslinking agent which effects a crosslinking reaction with a silicone modified polymer and/or an aqueous binder is used as well, and it is desirable that the silicone modified polymer and/or aqueous binder has as a functional group at least one functional group selected from the group consisting of a carboxyl group, an amino group, an ammonium salt group, a hydroxyl group, a sulfinic acid (or salt thereof) group, a sulfonic acid (or salt thereof) group, and a glycidyl group.

As the above-described crosslinking agent, for example, a vinylsulfone-based compound, an aldehyde-based compound (formaldehyde, glutaraldehyde and the like), an epoxy-based compound, an oxazine-based compound, a triazine-based compound, a polymer hardening agent described in Japanese Patent Application Laid-Open (JP-A) No. 62-234157, methylated melamine, a blocked isocyanate, a methylol compound, a carbodiimide resin, and the like can be used.

Among these cross-linking agents, a vinylsulfone-based compound, an aldehyde-based compound, an epoxy-based compound, an oxazine-based compound, a triazine-based compound, and a polymer hardening agent described in Japanese Patent Application Laid-Open(JP-A) No. 62-234157 are most suitable.

The protective layer in the heat sensitive recording material of the present invention contains a silicone modified polymer in an amount of 0.1% by weight or more, preferably of 1 to 100% by weight, and particularly preferably of 10% by weight or more. When the content of the silicone modified polymer is less than 0.1% by weight, the above-described properties of the silicone modified polymer are not fully manifested.

In the protective layer, in addition to the silicone modified polymer, other aqueous binder components may be used as well where necessary, and examples of the water-soluble polymer include methylcellulose, carboxymethylcellulose, hydroxyethylcellulose, starches, agar, κ-carageenan, gelatin, gum arabic, casein, styrene-maleic anhydride copolymer hydrolyzate, ethylene-maleic anhydride copolymer hydrolyzate, isobutylene-maleic anhydride copolymer hydrolyzate, polyvinyl alcohol, modified polyvinyl alcohol, polyacrylamide and the like.

Among these polymers, a water-soluble polymer which can be set-dried is suitable. A water-soluble polymer which can be set-dried means a water-soluble polymer which, when heated (for example, to around 40° C.), reveals a given viscosity and can be coated, and when cooled (for example, to 5° C. to 15° C.) thereafter, the viscosity increases and the fluidity ceases leading to the polymer gelling.

In the present invention, examples of a suitable polymer as the water-soluble polymer which can be set-dried include proteins such as gelatin and the like, polysaccharides such as carageenan, agar, and the like, polyvinyl alcohol-based .compounds, and the like. In the case of the polyvinyl alcohol-based compounds, they can be used together with boric acid or a salt thereof as a gelling agent to obtain a water-soluble polymer which can be set-dried.

In the present invention, it is difficult for the silicone modified polymer alone to be set-dried, but if the silicone modified polymer is used together with the above-described water-soluble polymer which can be set-dried, formation of the protective layer becomes easy. If the protective layer is formed in this way, a silicone modified polymer having a relatively high Tg (glass transition point) tends to be oriented in the vicinity of the surface of the protective layer, and a layer formed by gelling of the water-soluble polymer tends to be formed in the protective layer therebelow.

Therefore, on the surface of the protective layer, the level of hardness is high, and therefore adhesion, trash deposition and the like on a thermal head can be prevented. Additionally, a smoothing treatment effect on the surface of the protective layer by a thermal head and the like is obtained, and further, because of the cushioning effect from the layer formed by the gelling of the water-soluble polymer in the protective layer, the tracking capability of the thermal head and the like is excellent and the color developing density can be increased.

As the aqueous binder, synthetic rubber latex, synthetic resin emulsion, and the like can also be used. Examples of a monomer constituting these polymer latices and emulsions include acrylate, methacrylate, crotonate, vinyl ester, maleic acid diester, fumaric acid diester, itaconic acid diester, acrylamides, methacrylamides, vinyl ethers, styrenes, acrylonitrile and the like.

More specifically, examples of the acrylate among these monomers include methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, acetoxyethyl acrylate, phenyl acrylate, 2-methoxy acrylate, 2-ethoxy acrylate, 2-(2-methoxyethoxy)ethyl acrylate and the like.

Examples of the methacrylate include methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate and the like.

Examples of the crotonate include butyl crotonate, hexyl crotonate and the like. Examples of the vinyl ester include vinyl acetate, vinyl propionate, vinyl butylate, vinyl methoxy acetate, vinyl benzoate and the like.

Examples of the maleic acid diester include diethyl maleate, dimethyl maleate, dibutyl maleate and the like. Examples of the fumaric acid diester include diethyl fumarate, dimethyl fumarate, dibutyl fumarate and the like. Examples of the itaconic acid diester include diethyl itaconate, dimethyl itaconate, dibutyl itaconate and the like.

Examples of the acrylamides include acrylamide, methylacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, phenylacrylamide and the like.

Examples of the methacrylamides include methylmethacrylamide, ethylmathacrylamide, n-butylmethacrylamide, tert-butylmethacrylamide, 2-methoxymethacrylamide, dimethylmethacrylamide, diethylmethacrylamide and the like.

Examples of the vinyl ethers include methylvinyl ether, butylvinyl ether, hexylvinyl ether, methoxyethylvinyl ether, dimethylaminovinyl ether and the like. Examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinylbenzoate, 2-methylstyrene and the like.

A polymer constituted by these monomers may be a homopolymer or a copolymer. Bipolymers or terpolymers of acrylates, methacrylates, styrenes, acrylic acid and methacrylic acid, as well as a copolymer of styrenes and butadiene are preferably used.

A polymer constituting the aqueous binder has a Tg (glass transition point) of 150° C. or less, preferably of 0° C. to 130° C., and particularly preferably of 40° C. to 100° C.

Among the modified polyvinyl alcohols, ethylene modified polyvinyl alcohol is particularly preferable. Although this ethylene modified polyvinyl alcohol itself can improve water resistance and the like, it is effective to use a crosslinking agent and a catalyst which promotes the reaction together with the ethylene modified polyvinyl alcohol to further improve water resistance, and specific examples of the crosslinking agent include those described above.

As the epoxy compound, two or more functional compounds can be used, and examples thereof include dibromophenylglycidyl ether, dibromoneopentyl glycol diglycidyl ether, emulsion of epoxycresol novolak resin, modified bisphenol A epoxy emulsion, diglycidyl adipate, diglycidyl o-phthalate, hydroquinone diglycidyl ether, bisphenol S glycidyl ether, terephthalic acid diglycidyl ether, glycidyl phthalimide, propylene polypropylene glycol diglycidyl ether, polytetramethylene glycol diglycidyl ether, allyl glycidyl ether, 2-ethylhexyl glycidyl ether, phenylglycidyl ether, phenol $(EO)_5$ glycidyl ether, p-tertiary butylphenylglycidyl ether, lauryl alcohol $(EO)_{15}$ glycidyl ether, glycidyl ether of an alcohol mixture each having 12 to 13 carbon atoms, glycerol polyglycidyl ether, trimethylolpropane polyglycidyl ether, resorcin diglycidyl ether, neopentyl glycol diglycidyl ether, 1,6-hexanediol diglycidyl ether, ethylene polyethyleneglycol diglycidyl ether, sorbitol polyglycidyl ether, sorbitan polyglycidyl ether, polyglycerol polyglycidyl ether, pentaerythritol polyglycidyl ether, diglycerol polyglydicyl ether, triglycidyl-tris(2-hydroxyethyl) isocyanurate and the like. Among these epoxy compounds, glycidyl ethers are particularly suitable.

It is desirable that the epoxy compound which is effective in the present invention has an epoxy equivalent of 70 to 1000 WPE. When the epoxy equivalent is over 1000 WPE, it becomes difficult to impart water resistance and is therefore undesirable.

The blocked isocyanate means a compound obtained by masking a terminal isocyanate group of an isocyanate by a blocking agent. Examples of the blocked isocyanate include (a) a blocked isocyanate in which a block body of a hydrophilic group composed of a carbamoyl.sulfonate group (—$NHCOSO_3^-$) is formed on the terminal end of the isocyanate compound to block an active isocyanate group, (b) a blocked isocyanate in which an active isocyanate group is blocked using isopropylidene malonate. This blocked isocyanate is obtained by a reaction of HDI isocyanurate, isopropylidene malonate, and triethylamine, (c) a blocked isocyanate in which an active isocyanate group is blocked by phenols, and the like. When such a blocked isocyanate is mixed with ethylene modified polyvinyl alcohol and heated, the ethylene modified polyvinyl alcohol is endowed with water resistance by improving the crosslinkage of the ethylene modified polyvinyl alcohol.

Further, as the vinylsulfone compound, there can be used those described in Japanese Patent Application Laid-Open (JP-A) Nos. 53-57257, 53-41221, Japanese Patent Application Publication(JP-B) Nos. 49-13563, 47-24259 and the like.

Examples of the aldehyde compound include monoaldehydes such as formaldehyde, acetaldehyde and the like, polyvalent aldehydes such as glyoxal, glutaraldehyde, dialdehyde starch and the like, and examples of the methylol compound include methylolmelamine, dimethylol urea and the like. In the case of the ethylene modified polyvinyl alcohol, an aldehyde-based compound is particularly suitable as a crosslinking agent.

It is desirable that the crosslinking agent is blended in an amount of 1 to 50 parts by weight based on 100 parts by weight of the water-soluble polymer, polymer latex or polymer emulsion. When the blending amount of the crosslinking agent is less than 1 part by weight, the degree of crosslinking improvement is low, and water resistance, chemical resistance and the like are insufficient. On the other hand, when the amount is more than 50 parts by weight, solution stability decreases which is undesirable.

Next, in the present invention, the heat sensitive recording layer may be a full-color heat sensitive recording layer or mono-color heat sensitive recording layer, and it is desirable that at least one heat sensitive recording layer mainly composed of a diazo compound, a coupler which effects a coupling reaction with the diazo compound, and a binder is coated on a substrate. In the case of this heat sensitive recording material, the protective layer is preferably formed by using at least a silicone graft polymer or a silicone block polymer. The silicone graft polymer or silicone block polymer may be one formed by an aqueous system also, and particularly, the heat sensitive recording material has cyan, yellow, and magenta color-forming sensitive recording layers desirably formed by diazo type compounds.

Further, a heat sensitive recording material formed by coating a transmission type heat sensitive recording layer on a transparent substrate is a suitable system for exhibiting the effects of the present invention. In the case of the full-color heat sensitive recording layer, a heat sensitive recording material comprising a substrate having thereon a photo-fixing type heat sensitive recording layer and a light transmittance controlling layer of which the light transmittance within the light fixing wavelength range decreases after fixation, and a protective layer thereon, is desirable.

Further, it is desirable that the photo-fixing type heat sensitive recording layer comprises a heat sensitive recording layer containing a diazonium salt compound of which the maximum absorption wavelength is 360±20 nm and a coupler which develops color by reacting with the diazonium salt compound, and a photo-fixing heat sensitive recording layer containing a diazonium salt compound of which the maximum absorption wavelength is 400±20 nm and a coupler which develops color by reacting with the diazonium salt compound.

Further, a heat sensitive recording material comprising a substrate having sequentially thereon a heat sensitive recording layer containing an electron donative dye and an electron acceptive compound, a photo-fixing type heat sensitive recording layer containing a diazonium salt compound of which the maximum absorption wavelength is 400±20 nm and a coupler which develops color by reacting with the diazonium salt compound, and a photo-fixing type heat sensitive recording layer containing a diazonium salt compound of which the maximum absorption wavelength is 360±20 nm and a coupler which develops color by reacting with the diazonium salt compound, and a light transmittance controlling layer and a protective layer thereon, is desirable.

Still further, a heat sensitive recording material comprising a substrate having sequentially thereon a photo-fixing type heat sensitive recording layer containing a diazonium salt compound of which the maximum absorption wavelength is 340±20 nm and a coupler which develops color by reacting with the diazonium salt compound, a photo-fixing type heat sensitive recording layer containing a diazonium salt compound of which the maximum absorption wavelength is 360±20 nm and a coupler which develops color by reacting with the diazonium salt compound, and a photo-fixing type heat sensitive recording layer containing a diazonium salt compound of which the maximum absorption wavelength is 400±20 nm and a coupler which develops color by reacting with the diazonium salt compound, and a light transmittance controlling layer and a protective layer thereon, is desirable.

In the present invention, since the light transmittance controlling layer contains a component which functions as a precursor of an ultraviolet ray absorbing agent, and the component does not function as an ultraviolet ray absorbing agent before irradiation by a light having a wavelength in the range which is necessary for fixing, the controlling layer manifests a high light transmittance, and when the photo-fixing type heat sensitive recording layer is fixed, a light having a wavelength in the range necessary for the fixing fully transmits the controlling layer, and the visible light transmittance is high. Therefore, there are no problems in the fixing of the heat sensitive recording layer.

The precursor of this ultraviolet ray absorbing agent begins to function as an ultraviolet ray absorbing agent by reacting under the influence of light, heat, and the like after the completion of irradiation by a light having a wavelength in the range necessary for the fixation of the photo-fixing type heat sensitive recording layer by light irradiation, therefore, most of the light having a wavelength in the range necessary for the fixation in the ultraviolet region is absorbed by the ultraviolet ray absorbing agent, and consequently, the transmittance decreases and the light fastness of the heat sensitive recording material increases. However, since there is no visible light absorption effect, the visible light transmittance does not substantially change.

At least one light transmittance controlling layer can be provided in the photo-fixing type heat sensitive recording material, and in the most desirable case, the controlling layer may be formed between the photo-fixing type heat sensitive recording layer and the outermost protective layer. However, it is also acceptable if the light transmittance controlling layer serves as the protective layer. The properties of the light transmittance controlling layer can be optionally selected depending on the properties of the photo-fixing type heat sensitive recording layer.

A heat sensitive recording material which is particularly effectively adapted to the present invention desirably comprises a substrate having thereon a photo-fixing type heat sensitive recording layer containing a diazonium salt compound of which the maximum absorption wavelength is 360±20 nm and a coupler which develops color by reacting with the diazonium salt compound, and a photo-fixing type heat sensitive recording layer containing a diazonium salt compound of which the maximum absorption wavelength is 400±20 nm and a coupler which develops color by reacting with the diazonium salt compound, and a light transmittance controlling layer on top of these layers. For this type of heat sensitive recording material, it is desirable that the light transmittance in the wavelength range for photo-fixation of the light transmittance controlling layer is desirably 65% or more at 360 nm, and the light transmittance after the fixation is 20% or less at 360 nm. In this case, light irradiation means light irradiation of 13 kJ/$m^2$ at a wavelength of 420 nm by a xenon lamp acceleration tester. Specifically, it means light irradiation for 4.0 hours at 0.9 W/$m^2$ by Weather Ometer Ci65 (manufactured by Atlas Electric Co.).

Further, the present invention is also applied to a heat sensitive recording material comprising a photo-fixing type heat sensitive recording layer containing a diazonium salt compound of which the maximum absorption wavelength is less than 340 nm and a coupler which develops color by reacting with the diazonium salt compound, and to a photo-fixing type heat sensitive recording layer containing a diazonium salt compound of which the maximum absorption wavelength is over 420 nm and a coupler which develops color by reacting with the diazonium salt compound.

Further, by changing the hue of each heat sensitive recording layer, a multicolor heat sensitive recording material is obtained. Namely, full-color image recording becomes possible, by selecting three primary colors, yellow, magenta and cyan in subtractive color mixing as the color developed hues of respective heat sensitive recording layers. In this case, the color developing mechanism of a heat sensitive recording layer to be directly laminated (lowermost layer of the heat sensitive recording layers) on the surface of a substrate may be of any color developing system comprising an electron donative dye and an electron acceptive dye, for example, a diazo color developing system comprising a diazonium salt and a coupler which reacts with the diazonium salt for color developing, a base color developing system which develops color by contacting with a basic compound, a chelate color developing system, a color developing system which develops color by reacting with a nucleophilic reagent to cause a releasing reaction, and the like. Among these, the diazo color developing system is desirable, and it is desirable that on this heat sensitive recording layer, two photo-fixing type heat sensitive recording layers each containing a diazonium salt compound having a different maximum absorption wavelength and a coupler which reacts with the diazonium salt compound for color developing are provided, and on these layers, a light transmittance controlling layer and an outermost protective layer are sequentially provided.

In the present invention, examples of a compound contained in the light transmittance controlling layer include the following general formula (5).

General formula (5):

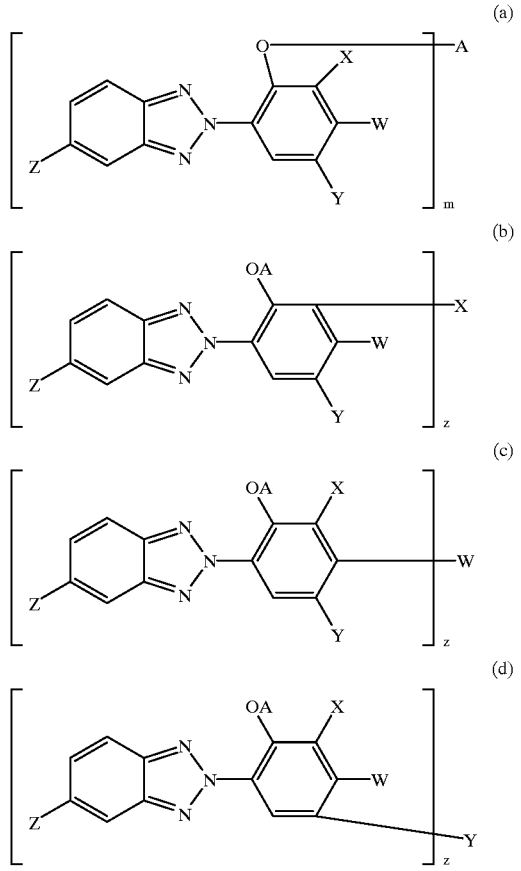

In the above-described general formula (5), m represents 1 or 2.

In the general formula (5) when m=1 and in the general formulae (a) to (d), A represents —$SO_2$—R, —CO—R, —$CO_2$R, —CONH—R, —$POR_1R_2$, —$CH_2R_3$ or —$SiR_4R_5R_6$, wherein R represents an alkyl group or an aryl group, $R_1$ and $R_2$ represent an alkoxy group, an aryloxy group, an alkyl group, or an aryl group, $R_3$ represents a phenyl group substituted with at least one nitro group or methoxy group, $R_4$, $R_5$ and $R_6$ represent an alkyl group or aryl group, and in the general formula (1) when m=2, A represents —$SO_2R_7SO_2$—, —CO—, —COCO—, —$COR_7CO$—, —$SO_2$— or —SO—, and $R_7$ represents an alkylene group or an arylene group.

In the general formulae (a), (c), and (d) of the general formula (5), X represents a hydrogen atom, an alkyl group, an alkoxy group, an aryl group, or a halogen atom, and in the general formula (b), x represents an alkylene group, —$OR_7O$— or —$OCOR_7CO_2$—. In the general formulae (a), (b) and (d), W represents a hydrogen atom, an alkyl group, an alkoxy group, an aryl group, or a halogen atom, and in the general formula (c), W represents —$OR_7O$— or —$OCOR_7CO_2$—.

In the general formulae (a), (b) and (c), Y represents a hydrogen atom, an alkyl group, an alkoxy group, an aryl group, or a halogen atom, and in the general formula (d), Y represents —$OR_7O$—, —$OCOR_7CO_2$—, —$CH_2CH_2CO_2R_7OCOCH_2CH_2$—, —$CH_2CH_2OCOR_7CO_2CH_2CH_2$—, or —$CH_2CH_2CON(R_8)R_7N(R_8)COCH_2CH_2$—, and $R_8$ represents a hydrogen atom or an alkyl group.

Z represents a hydrogen atom, a halogen atom, an alkyl group or an alkoxy group.

Among the above described substituents, the alkyl group may be normal or branched, and may also have an unsaturated bond.

Further, these alkyl groups may be substituted by an alkoxy group, an aryloxy group, an alkoxycarbonyl group, an aryloxycarbonyl group, an aryl group, a hydroxyl group, and the like. The aryl group may further be substituted with an alkyl group, an alkoxy group, or a halogen atom.

Among the above described substituents, also the alkylene group may be normal or branched, and may also have an unsaturated bond, an oxygen atom, a sulfur atom, or a nitrogen atom. The alkylene group may further be substituted with an alkoxy group, a hydroxyl group, an aryloxy group, or an aryl group.

Among the above described substituents, the arylene group may further be substituted with an alkyl group, an alkoxy group, a halogen atom, or the like.

In the substituents represented by X, Y and W, a hydrogen atom, an alkyl group having 1 to 18 carbon atoms, an alkoxy group having 1 to 18 carbon atoms, an aryl group having 6 to 18 carbon atoms, a fluorine atom, a chlorine atom, and a bromine atom are preferred, and of these, a hydrogen atom, an alkyl group having 1 to 12 carbon atoms, an alkoxy group having 1 to 12 carbon atoms, a phenyl group, and a chlorine atom are particularly preferred.

In the substituents represented by Z, a hydrogen atom, a chlorine atom, a fluorine atom, an alkyl group having 1 to 12 carbon atoms, and an alkoxy group having 1 to 12 carbon atoms are preferred, and of these, a hydrogen atom, a chlorine atom, an alkyl group having 1 to 6 carbon atoms, and an alkoxy group having 1 to 6 carbon atoms are particularly preferred.

In the substituents represented by R, an alkyl group having 1 to 18 carbon atoms, and an aryl group having 6 to 18 carbon atoms are preferred, and of these, an alkyl group having 1 to 12 carbon atoms, and an aryl group having 6 to 12 carbon atoms are particularly preferred.

In the substituents represented by $R_1$ and $R_2$, an alkoxy group having 1 to 12 carbon atoms, an aryloxy group having 6 to 12 carbon atoms, an alkyl group having 1 to 12 carbon atoms, and an aryl group having 6 to 12 carbon atoms are preferred.

In the substituents represented by $R_3$, 2-nitrophenyl group, 3,5-dimethoxyphenyl group, and 3,4,5-trimethoxyphenyl group are preferred.

In the substituents represented by $R_4$, $R_5$, and $R_6$, an alkyl group having 1 to 12 carbon atoms and an aryl group having 6 to 12 carbon atoms are preferred. Of these, an alkyl group having 1 to 8 carbon atoms and a phenyl group are particularly preferred.

In a so-called bis body having two benzotriazole rings in one molecule, as the substituent represented by R,, an alkylene group having 1 to 12 carbon atoms or an arylene group having 6 to 12 carbon atoms is preferable, and as the substituent represented by $R_8$, a hydrogen atom or an alkyl group having 1 to 6 carbon atoms is preferable.

Among the substituents represented by A, $—SO_2R$ is particularly preferable.

Specific examples of the above-described substituents include, but are not limited to, the following groups. Among the substituents represented by X, Y and W, examples of monovalent substituents include a hydrogen atom, a methyl group, an ethyl group, an n-propyl group, an isopropyl group, an n-butyl group, an isobutyl group, a sec-butyl group, a t-butyl group, a pentyl group, a hexyl group, an octyl group, a decyl group, a dodecyl group, an allyl group, a 2-butenyl group, a benzyl group, an α-dimethylbenzyl group, a methoxy group, an ethoxy group, a propyloxy group, a butyloxy group, an octyloxy group, a dodecyloxy group, a methoxyethoxy group, a phenoxyethoxy group, a methoxycarbonylethyl group, an ethoxycarbonylethyl group, a propyloxycarbonylethyl group, a butyloxicarbonylethyl group, an octyloxycarbonylethyl group, a phenoxycarbonylethyl group, a phenyl group, a tolyl group, a chlorine atom, a fluorine atom, a bromine atom, and the like, and examples of bivalent substituents include the following groups.

X: $—CH_2—$, $—CH_2—CH_2—$, $—O—CH_2—CH_2—O—$, $—O—(CH_2)_8—O—$, $—O—\underset{\underset{O}{\|}}{C}—(CH_2)_4—\underset{\underset{O}{\|}}{C}—O—$

W: $—O—(CH_2)_6O—$,

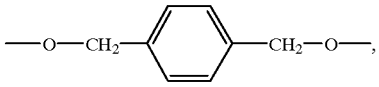

$—O—CH_2—$ $—CH_2—O—$, $—O—(CH_2)_2O—(CH_2)_2O—$, $—O—(CH_2)_2S—(CH_2)_2O—$,

Y: $—O—CH_2—\underset{\underset{CH_3}{|}}{CH}—O—$, $—CH_2CH_2—CO_2—(CH_2)_4OCO—CH_2—CH_2—$, $—CH_2—CH_2—CO_2—CH_2—CH_2—O—CH_2—CH_2—O—CO—CH_2—CH_2—$, $—CH_2—CH_2—OCO(CH_2)_8CO_2—CH_2—CH_2—$, $—CH_2—CH_2—CONH(CH_2)_6NHCO—CH_2—CH_2—$ Specific examples of the substituents represented by Z include a hydrogen atom, a chlorine atom, a methyl group, an ethyl group, a propyl group, a hexyl group, a methoxy group, an ethoxy group, a propyloxy group, an octyloxy group, and the like.

Among the substituents represented by A, examples of monovalent substituents include a methanesulfonyl group, an ethanesulfonyl group, a butanesulfonyl group, a benzenesulfonyl group, a 4-methylbenzenesulfonyl group, a 2-mesitylenesulfonyl group, a 4-methoxybenzenesulfonyl group, a 4-octyloxybenzenesulfonyl group, a 2,4,6-triisopropylbenzenesulfonyl group, a β-styrenesulfonyl group, a vinylbenzenesulfonyl group, a 4-chlorobenzenesulfonyl group, a 2,5-dichlorobenzenesulfonyl group, a 2,4,5-trichlorobenzenesulfonyl group, a 1-naphthalenesulfonyl group, a 2-naphthalenesulfonyl group, a quinolinesulfonyl group, a thiophenesulfonyl group, an acetyl group, a propionyl group, a butyryl group, a pivaloyl group, a lauroyl group, a stearoyl group, a benzoyl group, a cinnamoyl group, a furoyl group, a nicotinoyl group, a methoxycarbonyl group, an ethoxycarbonyl group, a phenoxycarbonyl group, a hexylaminocarbonyl group, a phenylaminocarbonyl group, a diphenylphosphoryl group, a diethylphosphoryl group, a 2-nitrobenzyl group, a 3,5-dimethoxybenzyl group, a 3,4,5-trimethoxybenzyl group, a trimethylsilyl group, a triethylsilyl group, a t-butyldimethylsilyl group, a diethylisopropylsilyl group, a dimethylphenylsilyl group, a diphenylmethylsilyl group, a triphenylsilyl group, and the like, and examples of the bivalent substituents include the following groups.

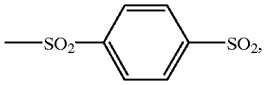

—CO—, —COCO—,

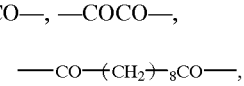

—SO—, —$SO_2$—

When A represents —$SiR_4R_5R_6$, a light acid generating agent such as an ammonium salt, a diazonium salt, an iodonium salt, a sulfonium salt, a phosphonium salt, an onium salt and the like may be used in combination to improve photo reactivity. Specific examples of these light acid generating agents are described in "Organic Material for Imaging" (Edited by Organic Electronics Material Study Group, 1993) in detail.

Specific examples of the compounds represented by the general formula (5) include, but are not limited to, the following compounds. These compounds can be used alone or in combinations of two or more.

TABLE 1

General formula (5) wherein m = 1

| * | A | X | W | Y | Z |
|---|---|---|---|---|---|
| (1) | 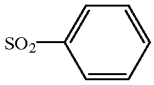 | H | H | $CH_3$ | H |
| (2) | " | " | " | $C_4H_9$(t) | " |
| (3) | " | " | " | $C_8H_{17}$(t) | " |
| (4) | " | " | " | $C_4H_9$(t) | Cl |
| (5) | 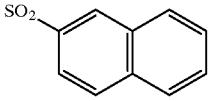 | " | " | " | H |

TABLE 1-continued

General formula (5) wherein m = 1

| * | A | X | W | Y | Z |
|---|---|---|---|---|---|
| (6) | 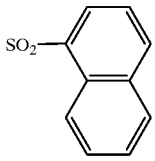 | " | " | " | " |
| (7) | 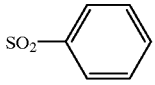 | $C_4H_9$ (sec) | " | $C_4H_9$(t) | H |
| (8) | 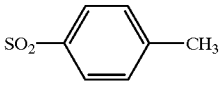 | " | " | " | " |
| (9) | 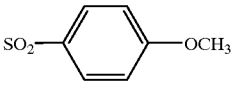 | " | " | " | " |
| (10) | 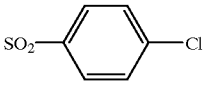 | " | " | " | " |
| (11) | 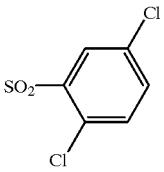 | " | " | " | " |
| (12) | 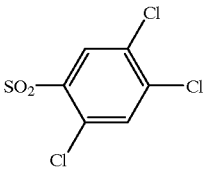 | " | " | " | " |
| (13) | 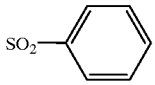 | $C_4H_9$(t) | " | " | H |
| (14) | 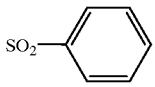 | " | " | " | Cl |
| (15) | 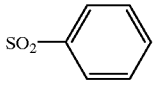 | " | " | " | $CH_3$ |

*Specific example

TABLE 2

General formula (5) wherein m = 1

| * | A | X | W | Y | Z |
|---|---|---|---|---|---|
| (16) | 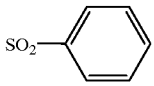 | $C_5H_{11}$(t) | H | $C_5H_{11}$(t) | H |
| (17) | " | $C_{12}H_{25}$ | H | $CH_3$ | H |
| (18) | " | H | $OC_8H_{17}$ | H | H |
| (19) | " | H | H | $OCH_3$ | H |
| (20) | " | $C_4H_9$(t) | H | $CH_2CH_2CO_2CH_3$ | H |
| (21) | " | " | " | $CH_2CH_2CO_2C_2H_5$ | Cl |
| (22) | " | " | " | $CH_2CH_2CO_2C_3H_7$ | " |
| (23) | " | " | " | $CH_2CH_2CO_2C_8H_{17}$ | " |
| (24) | " | " | " | $CH_3$ | " |
| (25) | " | $CH_2CH{=}CH_2$ | " | $C_4H_9$(t) | H |
| (26) | " | " | " | $C_4H_9$(t) | Cl |
| (27) | " | " | " | $C_8H_{17}$(t) | H |
| (28) | $COCH_3$ | H | H | $C_4H_9$(t) | " |
| (29) | 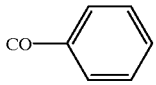 | $C_4H_9$(t) | H | $C_4H_9$(t) | Cl |
| (30) | $CO_2CH_3$ | 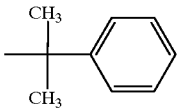 | H | 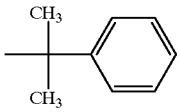 | H |

*Specific example

TABLE 3

General formula (5) wherein m = 1

| * | A | X | W | Y | Z |
|---|---|---|---|---|---|
| (31) | $CO_2C_2H_5$ | $C_4H_9$(t) | H | $C_4H_9$(t) | $OCH_3$ |
| (32) | 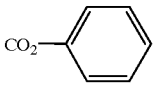 | $C_4H_9$(t) | H | $CH_2CH_2CO_2C_8H_{17}$ | H |
| (33) | 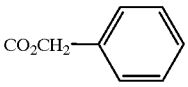 | $C_5H_{11}$(t) | H | $C_5H_{11}$(t) | H |
| (34) | 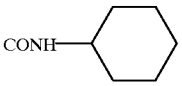 | " | " | " | " |
| (35) | 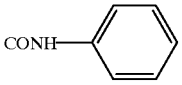 | " | " | " | " |
| (36) | $PO(OC_2H_5)_2$ | " | " | " | " |
| (37) | 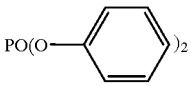 | " | " | " | " |

TABLE 3-continued
| General formula (5) wherein m = 1 | | | | | |
|---|---|---|---|---|---|
| * | A | X | W | Y | Z |
| (38) | 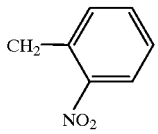 | " | " | " | " |
| (39) | 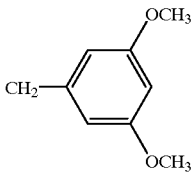 | " | " | " | " |
| (40) | $Si(CH_3)_3$ | $C_4H_9$(sec) | " | $C_4H_9$(t) | " |
| (41) | $Si(C_2H_5)_3$ | " | " | " | " |
| (42) | $Si(CH_3)_2C_4H_9$(t) | " | " | " | " |
| (43) | 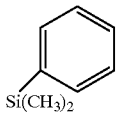 | " | " | " | " |
| (44) | 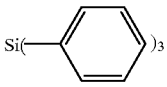 | H | H | " | " |
| (45) | $Si(CH_3)_3$ | $C_4H_9$(t) | H | " | " |
*Specific example
General formula (5) wherein m=2
Specific example (46)
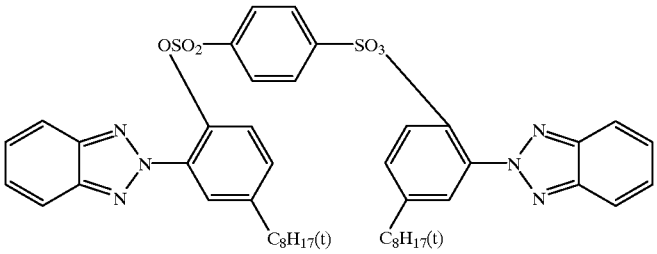
Specific example (47)
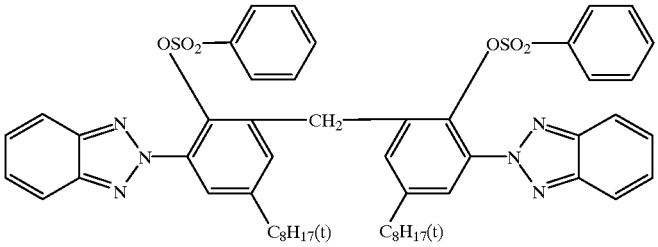

-continued

Specific example (48)

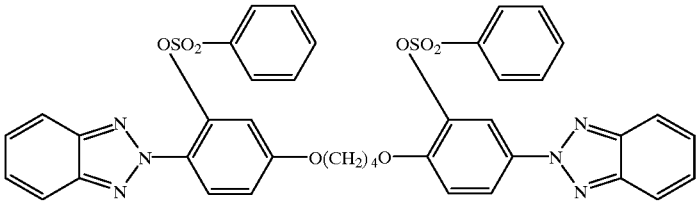

Specific example (49)

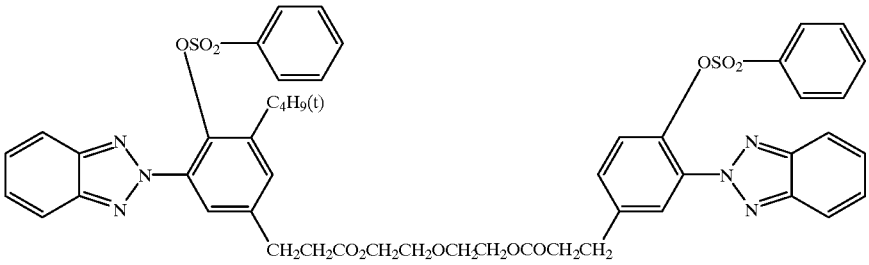

The compound represented by the general formula (5) does not absorb the fixing light when a heat sensitive recording material is fixed, and can improve the light stability of an image by absorbing the ultraviolet rays having an even longer wavelength by being irradiated with light after formation of the image.

The heat sensitive recording material containing the compound represented by the general formula (5) is applied to (1) a method in which the material is solid-dispersed for use, (2) a method in which the material is emulsion-dispersed for use, (3) a method in which the material is polymer-dispersed for use, (4) a method in which the material is latex-dispersed for use, (5) a method in which the material is microencapsuled for use, and the like, and of these, the microencapsulation method is particularly preferably used.

The compound represented by the general formula (5) may be contained in a protective layer to impart to the layer a function as a light transmittance controlling layer together with a function as a protective layer, and further, a light transmittance controlling layer containing the compound represented by the general formula (3) may be provided in addition to the protective layer. When the protective layer or the light transmittance controlling layer is formed, the compound represented by the general formula (3) is coated in an amount of desirably 0.35 g/m$^2$ or more, and particularly desirably 0.35 to 1.5 g/m$^2$. In this case, when the coating amount is less than 0.35 g/m$^2$, the ability to control light transmission deteriorates, and in particular, it becomes difficult to reduce the light transmittance in the ultraviolet region after the completion of irradiation with a light having a wavelength within the range necessary for fixation, and therefore, light fastness tends to decrease. On the other hand, when the coating amount is over 1.5 g/m$^2$, the ability to control light transmittance deteriorates, and in particular, light transmittance before irradiation with a light having a wavelength within the range necessary for fixation tends to decrease, causing problems to occur in the fixation.

In the emulsion-dispersion method, the compound represented by the general formula (5) is first dissolved into an oil. This oil may be solid or liquid at ordinary temperature, and may be a polymer. Examples thereof include auxiliary solvents having a low boiling point such as acetate, methylene chloride, cyclohexanone, and the like and/or a phosphate, phthalates, acrylate, methacrylate, other carboxylates, fatty acid amide, alkylated biphenyl, alkylated terphenyl, alkylated naphthalene, diarylethane, chlorinated paraffin, alcohols, phenols, ethers, monoolefins, epoxy compounds and the like. Specific examples thereof include oils having a high boiling point such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolylethane, 2,4-ditertiaryamylphenol, N,N-dibutyl-2-butoxy-5-tertiaryoctylaniline, 2-ethylhexyl hydroxybenzoate, polyethylene glycol and the like, and among these, alcohols, phosphates, carboxylates, alkylated biphenyl, alkylated terphenyl, alkylated naphthalene and diarylethane are particularly preferred. Further, a carbonization preventing agent such as hindered phenol, hindered amine and the like may be added to the above-described high boiling point oils. As the oil, one comprising an unsaturated fatty acid is particularly desirable, and α-methylstyrene dimer and the like can be listed. As the α-methylstyrene dimer, for example, MSD 100 (trade name of Mitsui Toatsu Chemicals, Inc.) and the like are listed.

An oil solution containing the compound represented by the above-described general formula (5) is added into an aqueous solution of a water-soluble polymer, and the mixture is emulsion-dispersed by a colloid mill, homogenizer, or ultrasonic wave. As the water-soluble polymer used therein, a water-soluble polymer such as polyvinyl alcohol and the like is used, can be used together with a hydrophobic polymer emulsion or latex. Examples of the water-soluble polymer include polyvinyl alcohol, silanol modified polyvinyl alcohol, carboxy modified polyvinyl alcohol, amino modified polyvinyl alcohol, itaconic acid modified polyvinyl alcohol, styrene-maleic anhydride copolymer, butadiene maleic anhydride copolymer, ethylene maleic anhydride copolymer, isobutylene maleic anhydride copolymer, polyacrylamide, polystyrenesulfonic acid, polyvinylpyrrolidone, ethylene-acrylic acid copolymer, gelatin, and the like, and among these, particularly, carboxy modified polyvinyl alcohol is preferable. As the hydrophobic polymer emulsion or latex, a styrene-butadiene copolymer, carboxy modified styrene-butadiene copolymer, acrylonitrile-butadiene copolymer and the like are listed. At this time, a conventionally known surfactant and the like may be added as necessary.

As the microencapsulation method, a conventionally known method for microencapsulation can be used. Namely, a microcapsule can be prepared by dissolving the compound represented by the general formula (5) and a microcapsule wall precursor into an organic solvent which is poorly soluble or insoluble in water, adding the resulting solution into an aqueous solution of a water-soluble polymer, emulsion-dispersing the mixture using a homogenizer and the like, and raising the temperature so that the polymer material is used for the microcapsule wall forms a wall layer at the oil/water interface. Specific examples of the polymer material used for the wall layer of a microcapsule include a polyurethane resin, polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, polyvinyl alcohol and the like. Amongthese, the particularlypreferable wall material is a microcapsule having a wall layer composed of a polyurethane polyurea resin.

The microcapsule having a wall layer composed of a polyurethane -polyurea resin is produced by mixing a microcapsule wall precursor such as polyvalent isocyanate and the like into a core material to be encapsuled, emulsion-dispersing the resulting mixture into an aqueous solution of a water-soluble polymer such as polyvinyl alcohol and the like, and raising the temperature of the solution to cause a polymer forming reaction at the interface of an oil drop.

A portion of the specific examples of the polyvalent isocyanate compound is shown below. Examples thereof include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene duisocyanate, hexamethylene diisocyanate, propylene-1,2-diisocyanate, butylene-1,2-diisocyanate, cyclohexylene-1,2-diisocyanate, cyclohexylene-1,4-diisocyanate and the like, triisocyanates such as 4,4',4"-triphenylmethane triisocyanate, toluene-2,4,6-triisocyanate and the like, tetraisocyanates such as 4,4'-dimethyldiphenylmethane-2,2',5,5'-tetraisocyanate and the like, isocyanate prepolymers such as an adduct of hexamethylene diisocyanate with trimethylolpropane, an adduct of 2,4-tolylene diisocyanate with trimethylolpropane, an adduct of xylylene diisocyanate with trimethylolpropane, an adduct of tolylene diisocyanate with hexane triol, and the like. Further, they can be used in combinations of two or more, where necessary. Among these, a compound containing three or more isocyanate groups in the molecule is particularly preferred.

As the organic solvent for dissolving the compound represented by the general formula (5) in the microcapsulation method, the oils listed for the emulsion-dispersing can be used, and the same applies for the water-soluble polymer. The particle size of the microcapsule is preferably from 0.1 to 1.0 $\mu$m, and more preferably in the range from 0.2 to 0.7 $\mu$m.

In the present invention, to further reduce coloration of the background when the image fades, a compound which is known as a reducing agent can be used together with the compound represented by the general formula (5). This reducing agent may be inside or outside of a microcapsule when the microcapsule is used. When the reducing agent is outside the microcapsule, the reducing agent migrates into the microcapsule when thermal printing is conducted. Examples of these additives include a hydroquinone-based compound, a hydrazide-based compound, a hydroxy compound, a phenidon-based compound, a catechol-based compound, a resorcinol compound, a hydroxyhydroquinone-based compound, a pyrrolo glycinol-based compound, a phenol-based compound, a phenylhydrazide-based compound, a gallic acid-based compound, an ascorbic acid-based compound, an ethylene glycol-based compound and the like. These compounds are described in Japanese Patent Application Laid-Open (JP-A) Nos. 3-191341, 3-25434, 1-252953, 2-302753, 1-129247, 1-227145, 1-243048, 2-262649 and the like. Specific examples thereof include N-phenylacetohydrazide, N-phenylbutyrylhydrazide, p-t-butylphenol, 2-azidobenzoxazole, and in addition to these, the following compounds.

R-1

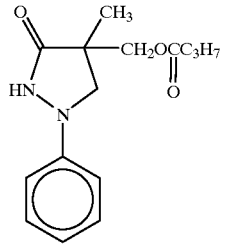

R-2

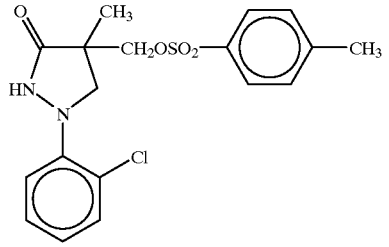

R-3

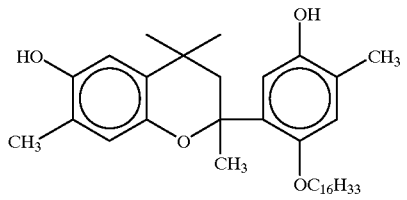

R-4

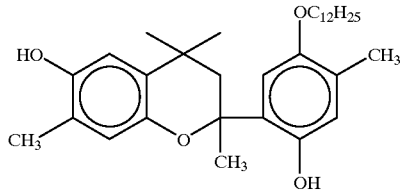

R-5

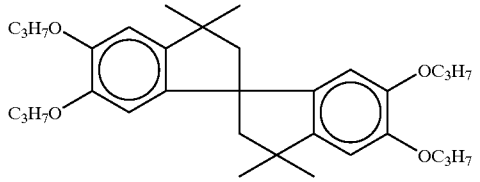

-continued

R-6

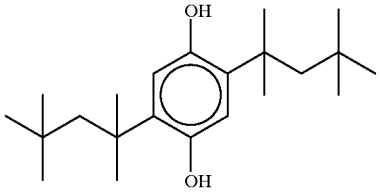

R-7

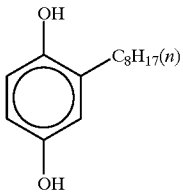

R-8

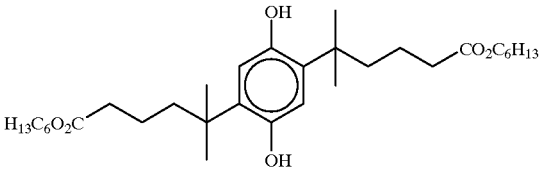

R-9

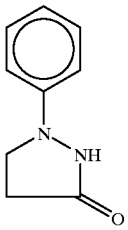

R-10

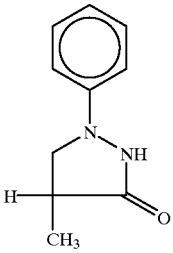

R-11

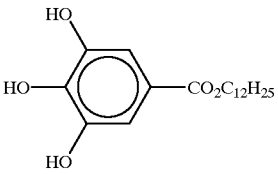

R-12

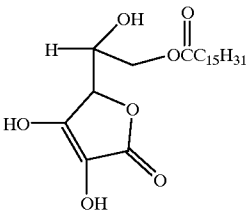

R-13

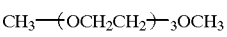

-continued

R-14

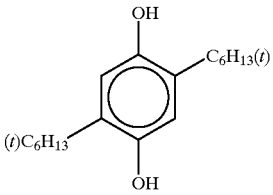

R-15

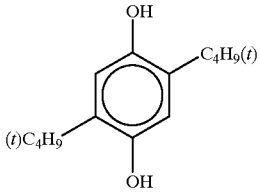

In the present invention, as the color developing component used in the heat sensitive recording layer, a conventionally known compound can be used, and in particular, a compound utilizing a reaction of a diazonium salt compound with a coupler, or a compound utilizing a reaction of an electron donative colorless dye with an electron acceptive compound is preferred. As the compound used in the heat sensitive recording layer containing a diazonium salt compound and a coupler which develops color by reacting under heat with the diazonium salt compound, a diazonium salt compound, a coupler which can form a dye by reacting with the diazonium salt compound, and a basic substance which promotes the reaction of the diazonium salt compound with the coupler, and the like, are listed. The diazonium salt compound is one expressed by the following compound. This is a compound of which the maximum absorption wavelength can be controlled depending on the type and position of the substituent in the Ar portion.

$$Ar—N_2^+X^-$$

Wherein, Ar represents an aryl group, and X represents an acid anion.

Specific examples of the diazonium salt compound in the present invention include acid anion salts of the compound such as 4-(N-(2-(2,4-di-tert-amylphenoxy)butyryl) piperazino)benzene diazonium, 4-dioctylaminobenzene diazonium, 4-(N-(2-ethylhexanoyl)piperazino)benzene diazonium, 4-dihexylamino-2-hexyloxybenzene diazonium, 4-N-ethyl-N-hexadecylamino-2-ethoxybenzodiazonium, 3-chloro-4-dioctylamino-2-octyloxybenzene diazonium, 2,5-dibutoxy-4-morpholinobenzene diazonium, 2,5-octoxy-4-morpholinobenzene diazonium, 2,5-dibutoxy-4-(N-(2-ethylhexanoyl)piperazino)benzene diazonium, 2,5-diethoxy-4-(N-(2-(2,4-di-tert-amylphenoxy)butyryl) piperazino)benzene diazonium, 2,5-dibutoxy-4-tolylthiobenzene diazonium, 3-(2-octyloxyethoxy)-4-morpholinobenzene diazonium and the like, and the following diazonium salt compounds D-1 to 5. A hexafluorophosphate salt, tetrafluoroborate salt and 1,5-naphthalene sulfonate salt are particularly preferred.

D-1

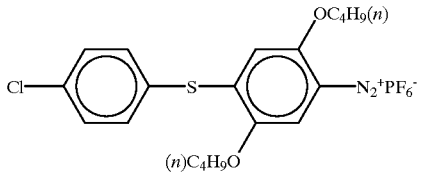

D-2

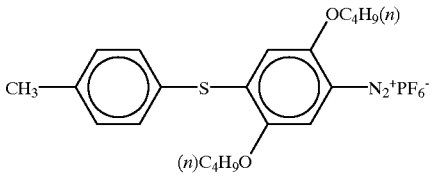

D-3

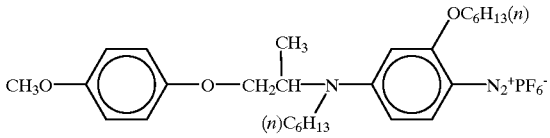

D-4

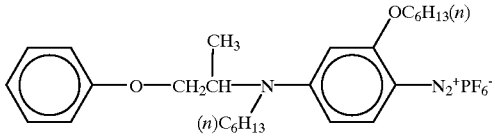

D-5

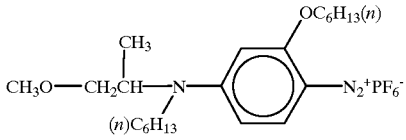

Among these diazonium salt compounds, examples of particularly preferable compounds in the present invention include 4-(N-(2-(2,4 -di-tert-amylphenoxy)butyryl) piperazino)benzene diazonium, 4-dioctylaminobenzene diazonium, 4-(N-(2-ethylhexanoyl)piperazino)benzene diazonium, 4-dihexylamino-2-hexyloxybenzene diazonium, 4-N-ethyl-N-hexadecylamino-2-ethoxybenzodiazonium, 2,5-dibutoxy-4-(N-(2-ethylhexanoyl)piperazino)benzene diazonium, 2,5-diethoxy-4-(N-(2-(2,4-di-tert-amylphenoxy) butyryl)piperazino)benzene diazonium which are photo-decomposed by a light having a wavelength of 300 to 400 nm and the compounds listed as specific examples in D-3 to 5. The maximum absorption wavelength of the diazonium salt compounds herein referred to is a value obtained by measuring a coated layer of each compound in an amount of 0.1 g/m$^2$ to 1.0 g/m$^2$ using a spectrophotometer (Shimazu MPS-2000).

Examples of the coupler which develops color by reacting under heat with the above-described diazonium salt used in the present invention include resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid anilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetanilide, acetacetoanilide, benzoylacetanilide, 2-chloro-5-octylacetacetoanilide, 1-phenyl-3-methyl-5-pyrazolone, 1-(2'-octylphenyl)-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamide-5-pyrazolone, and further, the following C-1 to 6 compounds, and the like. These couplers can also be used in combinations of two or more to obtain the intended color developed hue.

C-1

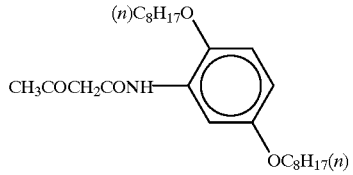

C-2

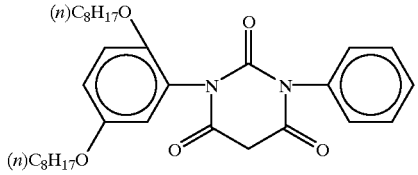

C-3

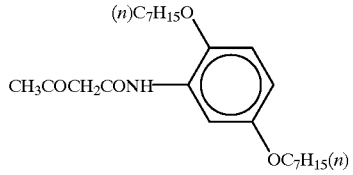

C-4

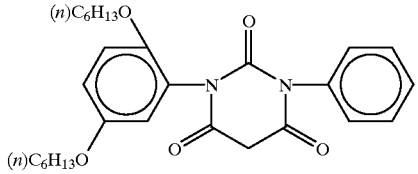

C-5

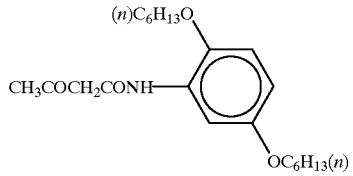

C-6

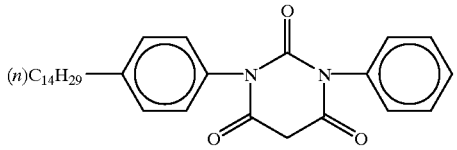

The basic substance includes compounds which cause decomposition and the like when heated to release an alkaline substance, in addition to inorganic or organic basic compounds. Representative examples thereof include nitrogen-containing compounds such as an organic ammonium salt, organic amine, amide, urea and thiourea and derivatives thereof, thiazoles, pyrroles, pyrimidines, piperazines, guanidines, indoles, imidazoles, imidazolines, triazoles, morpholines, piperidines, amidines, formazines, pyridines and the like. Specific examples thereof include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidinetrichloro acetate, N,N'-dibenzylpiperazine, 4,4'-dithiomorpholine, morpholiniumtrichloroacetate, 2-aminobenzothiazole, 2-benzoylhydrazinobenzothiazole, and the like. These can be used in combinations of two or more.

As the electron donative dye precursor used in the present invention, a triarylmethane-based compound, a diphenylmethane-based compound, a thiazine-based compound, a xanthene-based compound, a spiropyran-based compound and the like, and a triarylmethane-based compound and a xanthene-based compound are especially useful due to their high color developing density. Partial examples thereof include 3,3-bis(p-dimethylaminophenyl)-6-dimethylaminophthalide (namely, crystal violet lactone), 3,3-bis(p-dimethylamino)phthalide, 3-(p-dimethylaminophenyl)-3-(1,3-dimethylindole-3-yl) phthalide, 3-(p-dimethylaminophenyl)-3-(2-methylindole-3-yl)phthalide, 3-(o-methyl-p-diethylaminophenyl)-3-(2-methylindole-3-yl)phthalide, 4,4'-bis(dimethylamino) benzhydrinbenzyl ether, N-halophenylleucoauramine, N-2,4,5-trichlorophenylleucoauramine, rhodamine-B-anilinolactam, rhodamine(p-nitroanilino)lactam, rhodamine-B-(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoylleucomethylene blue, p-nitrobenzylleucomethylene blue, 3-methyl-spiro-dinaphthopyran, 3-ethyl-spiro-dinaphthopyran, 3,3'-dichloro-spiro-dinaphthopyran, 3-benzylspirodinaphthopyran, 3-propyl-spiro-dibenzopyran and the like.

As the electron acceptive compound, a phenol derivative, salicylic acid derivative, hydroxybenzoate, and the like are listed. Particularly, bisphenols and hydroxybenzoates are preferred. Partial examples thereof include 2,2-bis(p-hydroxyphenyl)propane (namely, bisphenol A), 4,4'-(p-phenylenediisopropylidene)diphenol (namely, bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl) propane, 1,1-(p-hydroxyphenyl)pentane, 1,1-(p-hydroxyphenyl)-2 -ethylhexane, 3,5-di(α-methylbenzyl) salicylic acid and polyvalent metal salts thereof, 3,5-di(tert-butyl)salicylic acid and polyvalent metal salts thereof, 3-α, α-dimethylbenzylsalicylic acid and polyvalent metal salts thereof, butyl p-hydroxybenzoate, benzyl p-hydroxybenzoate, 2-ethylhexyl p-hydroxybenzoate, p-phenylphenol, p-cumylphenol and the like.

As the sensitizer, an organic compound having a low boiling point suitably comprising an aromatic group and a polar group in the molecule, in the desired amounts is preferred, and examples thereof include benzyl p-benzyloxybenzoate, α-naphthylbenzyl ether, β-naphthylbenzyl ether, phenyl β-naphtoate, phenyl α-hydroxy-β-naphtoate, β-naphthol-(p-chlorobenzyl) ether, 1,4-butane diol phenyl ether, 1,4-butane diol-p-methylphenyl ether, 1,4-butane diol-p-ethylphenyl ether, 1,4-butane diol-m-methylphenylether, 1-phenoxy-2-(p-tolyloxy)ethane, 1-phenoxy-2-(p-ethylphenoxy)ethane, 1-phenoxy-2-(p-chlorophenoxy)ethane, p-benzylbiphenyl and the like.

In the present invention, embodiments to be used of the above-described diazonium salt compound, the coupler which develops color by reacting under heat with the diazonium salt compound, the basic substance, the electron donative colorless dye, the electron acceptive compound, and the sensitizer are not particularly restricted. Namely, like the compound represented by the general formula (5), there can be used (1) a method in which the material is solid-dispersed for use, (2) a method in which the material is emulsion-dispersed for use, (3) a method in which the material is polymer-dispersed for use, (4) a method in which the material is latex-dispersed for use, (5) a method in which the material is microencapsuled for use, and the like, and among these, the microencapsulation method is preferred in view of its preservability. Particularly, in the color developing system utilizing a reaction of the diazonium salt compound with the coupler, microencapsulation of the diazonium salt compound is preferable, and in the color developing system utilizing a reaction of the electron donative colorless dye with the electron acceptive compound, microencapsulation of the electron donative colorless dye is preferable.

For preparing a microcapsule, the same method as that for the compound represented by the general formula (5) can be used.

In the present invention, the above-described heat sensitive recording layers may be laminated, and a multicolor heat sensitive recording material can be obtained by changing the color hue of each heat sensitive recording layer. The constitution of the layers is not particularly restricted, and a multicolor heat sensitive recording material in which two heat sensitive recording layers containing two diazonium salt compounds having different photosensitive wavelengths and couplers which develop colors of different hues by reacting under heat with the respective diazonium salt compounds in combination, and a heat sensitive recording layer containing an electron donative colorless dye and an electron acceptive compound in combination, are laminated, and a multicolor heat sensitive recording material in which three heat sensitive recording layers containing three diazonium salt compounds having different photosensitive wavelengths and couplers which develop colors of different hues by reacting under heat with the respective diazonium salt compounds in combination, and a heat sensitive recording layer containing an electron donative colorless pigment and an electron acceptive compound in combination are laminated, are preferred, and the latter is particularly preferred.

Namely, the heat sensitive recording material comprises a substrate having thereon a first heat sensitive recording layer containing an electron donative colorless dye and electron acceptive compound or a diazonium compound having a maximum absorption wavelength of 340 nm or less and a coupler which develops color by reacting under heat with the diazonium salt compound, a second heat sensitive recording layer containing a diazonium compound having a maximum absorption wavelength of 360±20 nm and a coupler which develops color by reacting under heat with the diazonium salt compound, and a third heat sensitive recording layer containing a diazonium compound having a maximum absorption wavelength of 400±20 nm and a coupler which develops color by reacting under heat with the diazonium salt compound. In this example, full color image recording becomes possible, by selecting three primary colors, yellow, magenta and cyan in subtractive color mixing as color developed hue of each heat sensitive recording layer.

To effect recording using this multicolor heat sensitive recording material, the third heat sensitive recording layer is first heated, in order for the diazonium salt compound and the coupler contained in the layer to color develop. Next, any unreacted diazonium compound contained in the third heat sensitive recording layer is decomposed by irradiation with a light having a wavelength of 400±20 nm, and next, heat which is sufficient to color develop the second heat sensitive recording layer is applied, to color develop the diazonium salt compound and the coupler contained in the layer. At this time, although the third heat sensitive recording layer is also intensely heated, no color development occurs since the diazonium salt compound has already been decomposed and the color developing ability thereof has been lost. Further, the diazonium compound contained in the second heat sensitive recording layer is decomposed by irradiation of a light having a wavelength of 360±20 nm, and finally, heat which is sufficient to color develop the first heat sensitive recording layer is applied, and color development is effected. At this time, although the third and second heat sensitive recording layers are also intensely heated, no color development occurs since the diazonium salt compounds have already been decomposed and the color developing abilities thereof have been lost.

In the present invention, in order to further improve the light fastness, known antioxidants as described in the following publications can be used. For example, European Patent Application Laid-Open (EP-A) No. 310551, German Patent Application Laid-Open(OLS) No. 3435443, European Patent Application Laid-Open (EP-A) No. 310552, Japanese Patent Application Laid-Open (JP-A) No. 3-121449, European Patent Application Laid-Open (EP-A) No. 459416, Japanese Patent Application Laid-Open (JP-A) Nos. 2-262654, 2-71262, 63-163351, U.S. Pat. No. 4,814,262, Japanese Patent Application Laid-Open (JP-A) Nos. 54-48535, 5-61166, 5-119449, U.S. Pat. No. 4,980,275, Japanese Patent Application Laid-Open (JP-A) Nos. 63-113536, 62-262047, European Patent Application Laid-Open (EP-A) Nos. 223739, 309402, 309401, and the like. Specific examples thereof include the following compounds.

Q-1

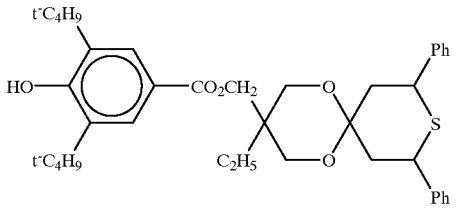

Q-2

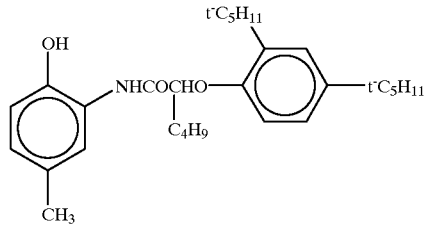

Q-3

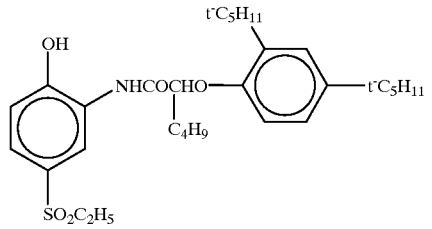

Q-4

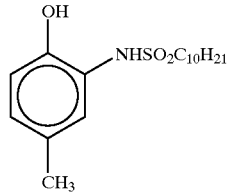

-continued
Q-5
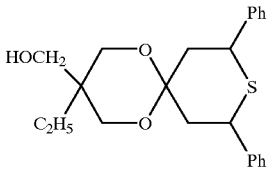
Q-6
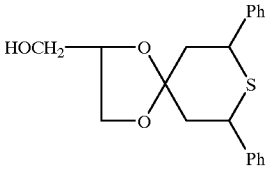
Q-7
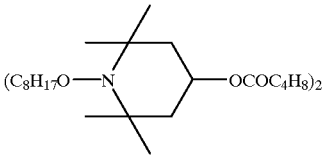
and
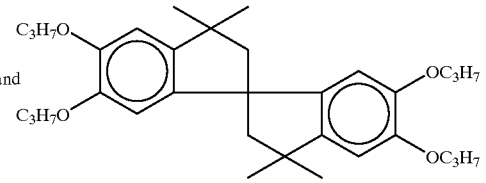
Q-8
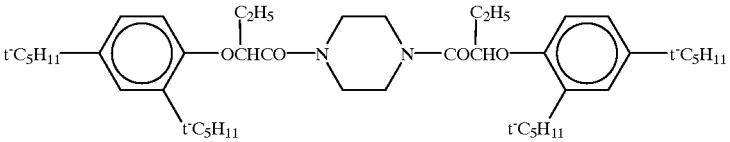
Q-9
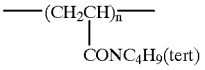
Q-10
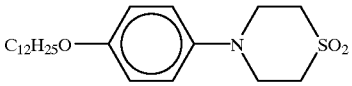
Q-11
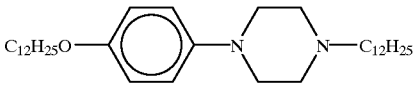
Q-12
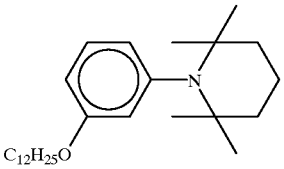
Q-13
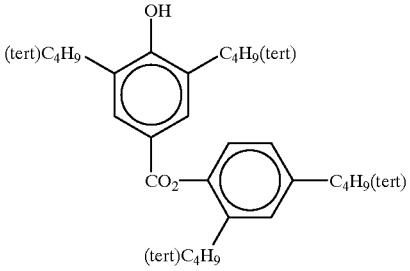

-continued
Q-14
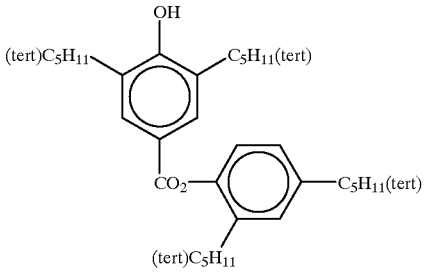
Q-15
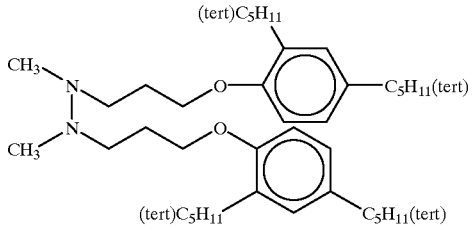
Q-16
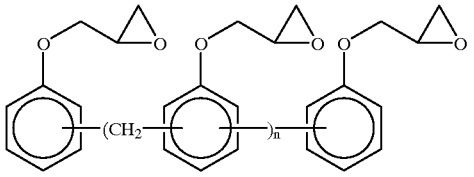
Q-17
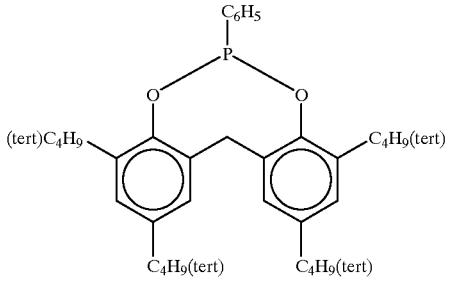
Q-18
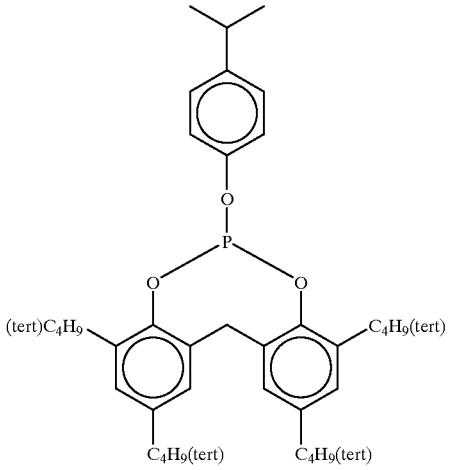

-continued
Q-19
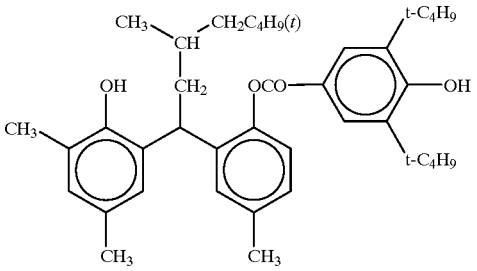
Q-20
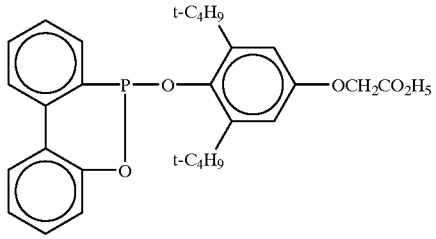
Q-21
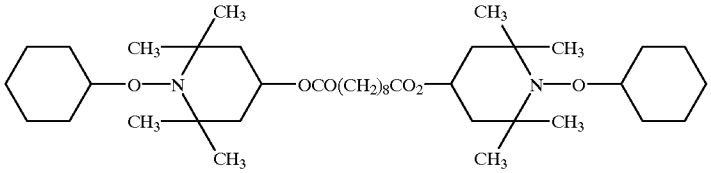
Q-22
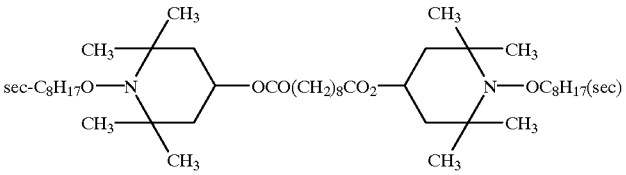
Q-23
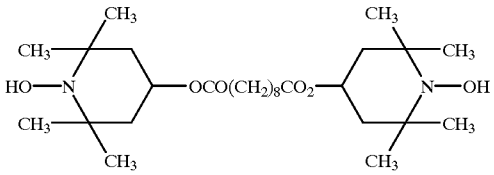
Q-24
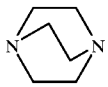
Q-25
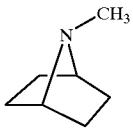
Q-26
$(C_{14}H_{27}OCOCH_2CH_2)_2S$
Q-27
$(C_{18}H_{37}OCOCH_2CH_2)_2S$
Q-28
$C_{12}H_{25}SCH_2CH_2CO_2CH_2)_4C$
In the present invention, it is preferable that at least one of the light transmittance controlling layer and the protective layer, preferably the protective layer, contains a compound obtained by saponification of a random copolymer having a vinyl ester unit represented by the following general formula (also called ethylene modified polyvinyl alcohol).

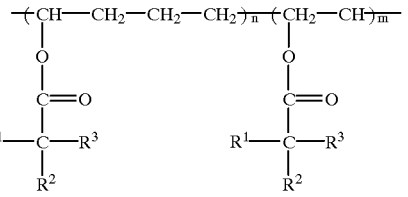

(wherein, $R^1$, $R^2$, and $R^3$ represent a hydrogen atom or a hydrocarbon group, $R^2$, and $R^3$ may bond with each other to form a cyclic hydrocarbon group, or $R^1$, $R^2$, and $R^3$ may bond with each other to form a cyclic hydrocarbon group.)

In this ethylene modified polyvinyl alcohol, an ethylene modified polyvinyl alcohol which is a random copolymer containing a vinyl alcohol monomer component of polyvinyl alcohol and an ethylene monomer in a ratio of 80:20 to 99:1 is particularly desirable. In the case of the ethylene modified polyvinyl alcohol, in order to obtain water-solubility and satisfactory water resistance, the ethylene modification degree is desirably from 20 molar % (namely, the ratio of a vinyl alcohol monomer component to an ethylene monomer is 80:20) to 1 molar % (namely, the ratio of a vinyl alcohol monomer component to an ethylene monomer is 99:1), and more desirably, the ethylene modification degree is from 5 to 10 molar %. In the case of an ethylene unmodified polyvinyl alcohol, satisfactory water resistance and chemical resistance are not obtained, and when the ethylene modification degree is over 20 molar %, solubility in water disadvantageously decreases.

Further, the ethylene modified polyvinyl alcohol desirably has a saponification degree of 80 molar % or more, and when the saponification degree is less than 80 molar %, solubility is insufficient, and it is difficult to prepare the required coating solution.

These ethylene modified polyvinyl alcohols may be further modified with other functional groups provided no reverse influence is exerted on its performance and coating solution stability. Examples of the other functional groups include a carboxyl group, a terminal end alkyl group, an amino group, a sulfonic acid group, a terminal end thiol group, a silanol group, an amido group, and the like. To impart solubility to the ethylene modified polyvinyl alcohol, carboxyl group modification, amino group modified sulfonic acid groups, and the like are effective.

It is also effective to further use various additives already known as heat sensitive recording materials and pressure sensitive recording materials. Partial examples of these antioxidants include compounds described in Japanese Patent Application Laid-Open(JP-A) Nos. 60-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1,108437, 05-170361, 63-203372, 63-224989, 63-267594, 63-182484, 60-107384, 60-107383, 61-160287, 61-185483, 61-211079, 63-251282, 63-051174, Japanese Patent Application Publication (JP-B) Nos. 48-043294, 48-033212, and the like.

Specific examples thereof include 6-ethoxy-1-phenyl-2,2,4-trimethyl-1,2-dihydroquinoline, 6-ethoxy-1-octyl- 2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanate, 2,2-bis-4-hydroxyphenylpropane, 1,1-bis-4-hydroxyphenyl-2-ethylhexane, 2-methyl-4-methoxydiphenylamine, 1-methyl-2-phenylindol and the compounds shown below.

Q-29

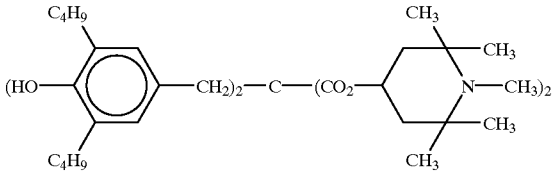

Q-30

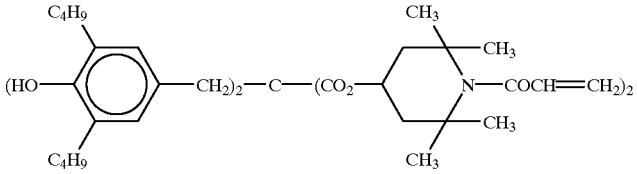

Q-31

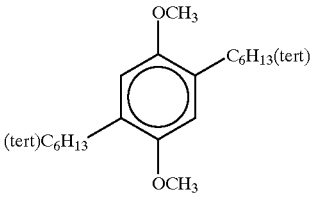

-continued
Q-32
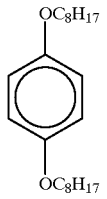
Q-33
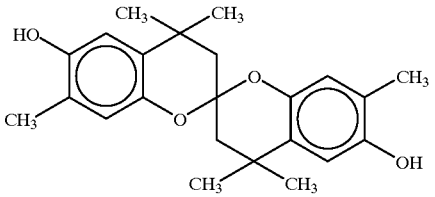
Q-34
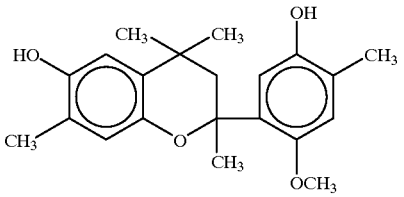
Q-35
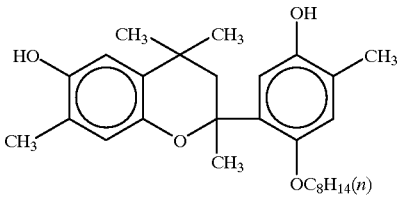
Q-36
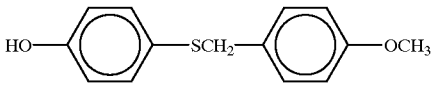
Q-37
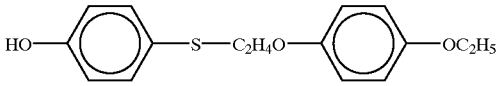
Q-38
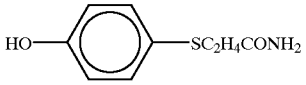
Q-39
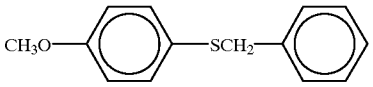
Q-40
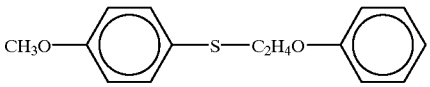
Q-41
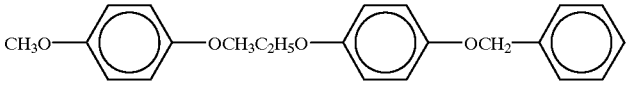

-continued
Q-42
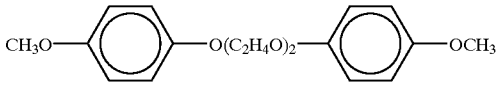
Q-43
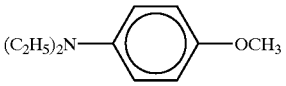
Q-44
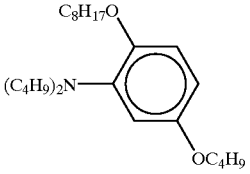
Q-45
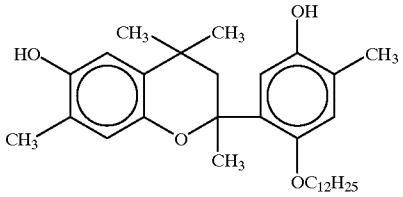
and
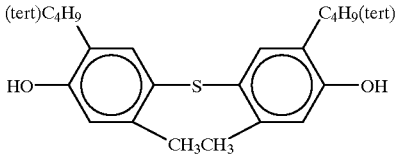
are used together
Q-46
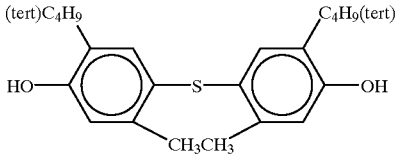
and hydroquinone ether are used together
Q-47
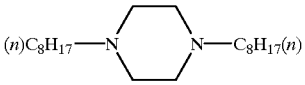
Q-48
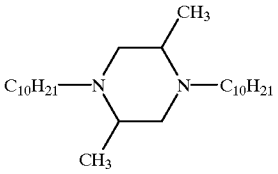
Q-49
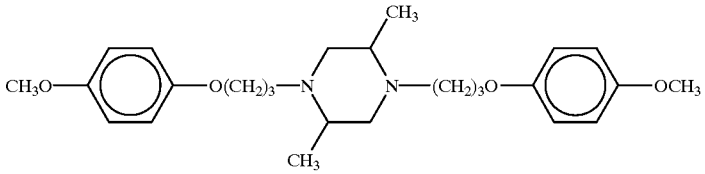
Q-50
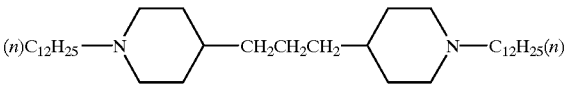
Q-51
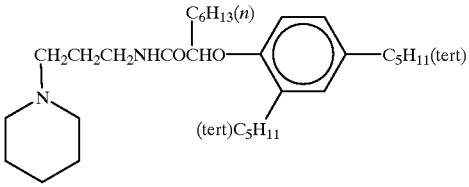

-continued
Q-52
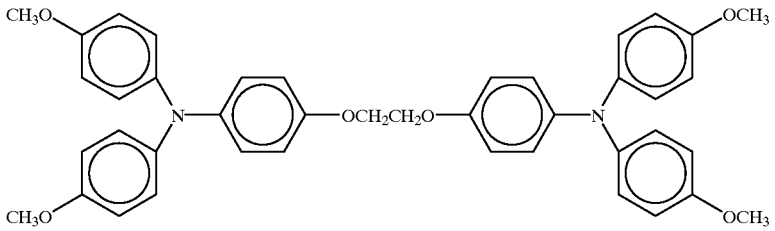
Q-53
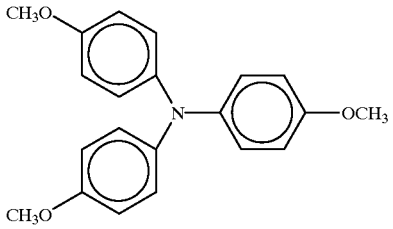
Q-54
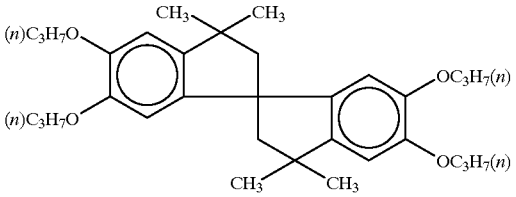
Q-55
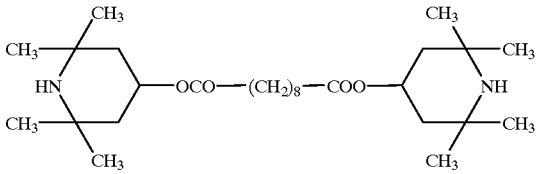
Q-56
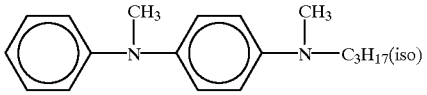
Q-57
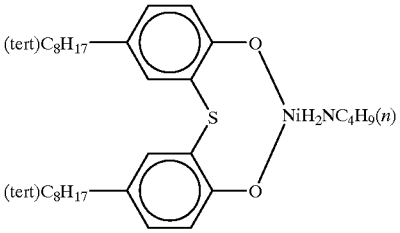
Q-58
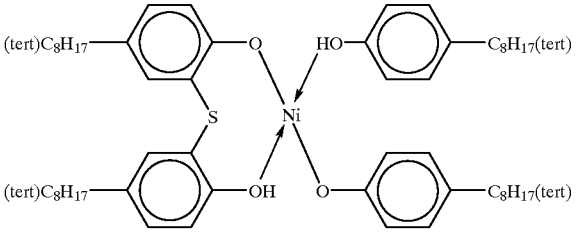
These antioxidants can be added to the heat sensitive recording layer, the intermediate layer, the light transmittance controlling layer, or the protective layer. When these antioxidants are used in combination, the specific examples of the combination of (Q-7), (Q-45), and (Q-46), or the combination of (Q-10) with (Q-13) are listed.

As the substrate in the present invention, plastic film, paper, plastic resin, laminated paper, synthetic paper and the like can be used.

In the present invention, when heat sensitive color developing layers to form different color hues are laminated, an intermediate layer can be provided to prevent color mixing and the like. When a material having a high 02 permeability such as laminated paper and the like is used as a substrate, light fastness can be improved by providing an undercoat layer as an $O_2$ cut layer. A water-soluble polymer compound is used in the intermediate layer and undercoat layer. Examples thereof include polyvinyl alcohol, modified polyvinyl alcohol, methylcellulose, sodium polystyrenesulfonate, styrene-maleic acid copolymer, gelatin and the like.

It is effective if the intermediate layer and undercoat layer contain a swelling inorganic layered compound described in Japanese Patent Application No. 7-113825, to improve the ability to prevent color mixing and to improve light fastness, even if the layers are thinner.

In the present invention, sufficient friction resistance and lubrication properties can be obtained even when no organic or inorganic pigment is used in the protective layer in applications where glossiness is required, however, depending on the application, any general organic or inorganic pigment can be used. Specific examples thereof include calcium carbonate, aluminum hydroxide, barium sulfate, titanium oxide, talc, agalmatolite, kaolin, calcined kaolin, amorphous silica, urea formalin resin powder, polyethylene resin powder, benzoguanamine resin powder and the like. These are used alone or in combinations of two or more.

In the coating solution for the protective layer of the present invention, a dispersion of the above-described pigment, a crosslinking agent, a catalyst, a releasing agent, a surfactant, wax, a water repellent agent, and the like may further be added where necessary to the silicone modified polymer. The resulting coating solution for the protective layer is coated on the heat sensitive recording layer by an apparatus such as a bar coater, air knife coater, blade coater, curtain coater and the like and dried, to obtain the protective layer of the present invention. This protective layer may be coated simultaneously with the recording layer, or the heat sensitive recording layer may be first coated, and dried, and then the protective layer may be coated thereon. The amount of dried coating of the protective layer is preferably from 0.1 to 3 g/m$^2$, and more preferably from 0.3 to 1.5 g m$^2$. When the coated amount is large, heat sensitivity decreases remarkably, on the other hand, if it is too small, then its ability to function (abrasion resistance, lubrication properties, scratch resistance, and the like) as a protective layer is not manifested. After coating of the protective layer, calender treatment may be conducted as required.

The above-described examples are explained with particular regard given to a full color heat sensitive recording layer, however, the present invention may be a heat sensitive recording material having a monocolor heat sensitive recording layer.

The monocolor heat sensitive recording layer of the present invention contains at least a substantially colorless color developing component A and a substantially colorless color developing component B which develops color by reacting with the color developing component A. The color developing component A and the color developing component B used in the present invention are components which cause a color developing reaction when they contact with each other, and examples of combinations thereof include the following (A) to (M).

(A) A combination of a photo decomposable diazo compound with a coupler.

(B) A combination of an electron donative dye precursor with an electron acceptive compound.

(C) A combination of an organic metal salt such as silver behenate or silver stearate with a reducing agent such as protocatechuic acid, spiroindane and hydroquinone.

(D) A combination of a long chain aliphatic acid salt such as iron (II) stearate and iron (II) myristate with phenols such as tannic acid, gallic acid and ammonium salicylate.

(E) A combination of an organic acid heavy metal salt such as nickel, cobalt, lead, copper, iron, mercury, and silver salts of acetic acid, stearic acid, palmitic acid, and the like with an alkaline earth metal sulfide, such as calcium sulfide, strontium sulfide, and potassium sulfide, or a combination of the above-described organic acid heavy metal salts with an organic chelating agent such as s-diphenylcarbazide and diphenylcarbazone.

(F) A combination of a heavy metal sulfate such as sulfates of silver, lead, mercury, and sodium with a sulfur compound such as Na-tetrathionate, sodium thiosulfate and thiourea.

(G) A combination of a fatty acid iron (II) salt such as iron (II) stearate with an aromatic polyhydroxy compound such as 3,4-hydroxytetraphenylmethane.

(H) A combination of an organic acid metal salt such as oxalate and mercury oxalate with an organic polyhydroxy compound such as polyhydroxy alcohol, glycerin and glycol.

(I) A combination of a fatty acid iron (II) salt such as iron (II) pelargonate and iron (II) laurate with derivatives of thiocetylcarbamide and isothiocetylcarbamide.

(J) A combination of an organic acid lead salt such as lead capronate, lead pelargonate and lead behenate with a thiourea derivative such as ethylenethiourea and N-dodecylthiourea.

(K) A combination of a higher fatty acid heavy metal salt such as iron (II) stearate and copper stearate with zinc dialkyldithiocarbamate.

(L) A combination which forms an oxazine dye such as a combination of resorcin with a nitroso compound.

(M) A combination of a formazan compound with a reducing agent and/or metal salt.

Among which, (A) a combination of a photo decomposable diazo compound with a coupler, (B) a combination of an electron donative dye precursor with an electron acceptive compound and (C) a combination or an organic metal salt with a reducing agent are preferable in the present invention, and (A) and (B) are more preferable, and (A) is particularly preferable.

EXAMPLES

In the following examples, all "parts" are by weight.

Example 1

Preparation of coating solution of protective layer

| | |
|---|---|
| RS 106 (10% by weight) | 100 g |
| Water | 50 g |
| X-22-8053 (40% by weight IPA solution) (manufactured by Shin-Etsu Silicone Co., Ltd.) | 10 g |
| Surfactant 1 (2% by weight) | 5 ml |
| Surfactant 2 (5% by weight) | 5 ml |

were added together and stirred uniformly to obtain the intended coating solution.

RS 106 is a PVA derivative (manufactured by Kuraray Co., Ltd.)

X-22-8053 is a silicone graft acrylic polymer (Tg=110° C.) (manufactured by Shin-Etsu Chemical Co., Ltd.) having a structural formula represented by the following formula 19.

General formula (4)

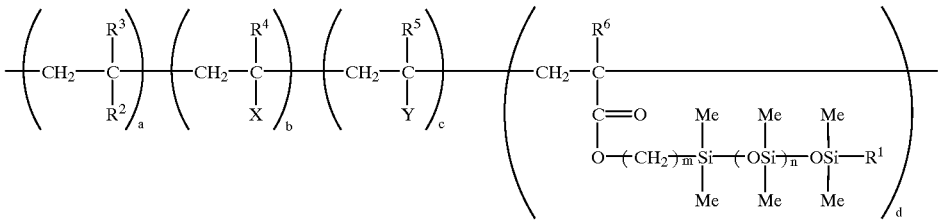

Surfactant 1 and surfactant 2 respectively have the following structural formulae.

Surfactant 1

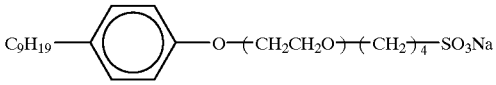

Surfactant 2

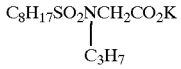

Preparation of coating solution for light transmittance controlling layer 1.5 parts of a compound of the specific example (23), 0.5 parts of R-6 as a reducing agent, 6.0 parts by ethyl acetate and 0.8 parts of tricresyl phosphate were mixed together and fully dissolved. 3.0 parts of xylylene diisocyanate/trimethylolpropane, (75% ethyl acetate solution: Takenate D110N: trade name of Takeda Chemical Industries, Ltd.) as a capsule wall agent was added to this solution, and the mixture was stirred to become uniform. 29.7 parts of 8% by weight carboxy modified polyvinyl alcohol (KL-318: trade name of Kuraray Co., Ltd.) aqueous solution was prepared, and added to the previously prepared solution, and emulsion-dispersion was conducted using a homogenizer. The resulting emulsion was added to 40 parts of ion-exchanged water, and the mixture was stirred for 3 hours at 40° C. to effect an encapulation reaction. Thereafter, 7.0 parts of an ion-exchanged resin, Amberlite MB-03 (trade name of Organo Corp.), was added, and stirring was continued for a further 1 hour. Thus, the intended coating solution was prepared. The average particle size of the capsules was 0.35 μm.

Preparation of a solution for a heat sensitive recording layer

Preparation of diazonium salt compound capsule solution 2.8 parts of a compound represented by a-1 having a maximum absorption wavelength of 365 nm as a diazonium salt compound, 2.8 parts of dibutyl sulfate and 0.56 parts of 2,2-dimethoxy-1,2-diphenylethane-1-one, (Irgacure 651: trade name of Ciba Geigy), were dissolved in 19.0 parts of ethyl acetate. Further, 5.9 parts of isopropylbiphenyl which is a solvent having a high boiling point and 2.5 parts of tricresyl phosphate were added to the previously prepared solution, and the mixture was heated and mixed uniformly. 7.6 parts of a xylylene diisocyanate/trimethylolpropane adduct, (75% ethyl acetate solution: Takenate D110N: trade name of Takeda Chemical Industries, Ltd.), as a capsule wall agent was further added to this solution, and the mixture was stirred uniformly. Separately, 64 parts of 6% by weight gelatin solution, (MGP-9066: trade name of Nippi Gelatin Industry Corp.) to which 2.0 parts of 10% by weight sodium dodecylsulfonate had been added was prepared, and added to the previously prepared diazonium salt compound solution, and emulsion-dispersed by a homogenizer. To the resulting emulsion was added 20 parts of water, and the mixture was made uniform. It was then heated up to 40° C. while being stirred and an encapsulation reaction was conducted for 3 hours. The solution temperature was then lowered to 35° C., and to this were added 6.5 parts of an ion-exchange resin, Amberlite IRA68 (manufactured by Organo Corp.), and 13 parts of Amberlite IRC50 (manufactured by Organo Corp.), and the mixture was further stirred for 1 hour. Thereafter, the ion-exchange resin was filtered to obtain the intended capsule solution. The average particle size of the capsule was 0.64 μm.

A-1

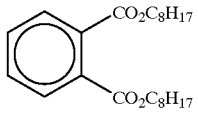

Preparation of a coupler emulsion-dispersed solution 3.0 parts of a compound b-1 as a coupler described below and 4.0 parts of triphenylguanidine, 4.0 parts of 1,1-(p-hydroxyphenyl)-2-ethylhexane, 8.0 parts of 4,4'-(p-phenylenediisopropylidene)diphenol, 8.0 parts of 2-ethylhexyl-4-hydroxybenzoate, 2.0 parts of a compound b-2 as an antioxidant, and 2.0 parts of 1,1,3-tris(2-methyl-4-hydroxy-5-t-butylphenyl)butane were dissolved in 10.5 parts of ethylacetate, and to this were further added 0.48 parts of tricresyl phosphate which is a solvent having a high boiling point, 0.24 parts of diethyl maleate, and 1.27 parts of Pionin A41C (manufactured by Takemoto Yushi Corp.), then, the mixture was heated and stirred uniformly. Separately, it was added to 93 parts of a 8% by weight gelatin (#750 Gelatin: trade name of Nitta Gelatin Corp.) aqueous solution, and emulsion-dispersed by a homogenizer. The remaining ethyl acetate was evaporated from this emulsion solution to obtain the intended emulsion-dispersed solution.

Preparation of coating solution

The above-described diazonium salt compound capsule solution, coupler emulsion-dispersed solution and further styrene-butadiene rubber, (trade name SBR: SN307 manufactured by Sumitomo Norgatack Corp.), were mixed so that the ratio of the diazonium salt compound/coupler was 1/2 and the ratio of the diazonium salt compound/styrene-butadiene rubber was 1/6.4, respectively, to prepare the intended coating solution.

a-1

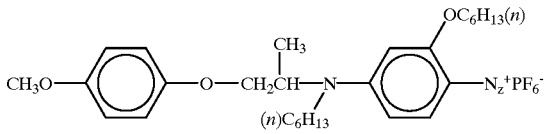

b-1

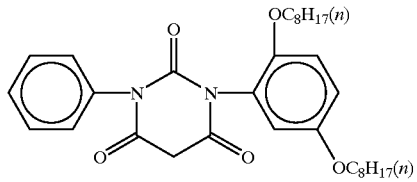

b-2

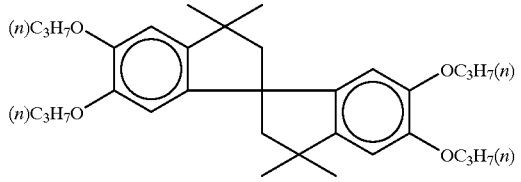

Production of a heat sensitive recording material

On a paper substrate for printing paper made by laminating polyethylene onto high quality paper, a heat sensitive recording layer, a light transmittance controlling layer, and a protective layer were sequentially coated in this order using a wire bar, and dried to obtain the intended heat sensitive recording material. The amounts coated as solid components were 8.33 g, 2.50 g, and 1.23 g respectively per 1 $m^2$.

Example 2

Preparation of a coating solution of a protective layer

| | |
|---|---|
| RS 110 (7% by weight) | 100 g |
| (PVA derivative, manufactured by Kuraray Co., Ltd.) | |
| Water | 52 g |
| X-22-8053 (40% by weight IPA solution) | 26.3 g |
| (manufactured by Shin-Etsu Silicone Co., Ltd.) | |
| Surfactant 1 (2% by weight) | 10 ml |
| Surfactant 2 (5% by weight) | 10 ml |
| Surflon S131 (30% by weight) | 1.5 g |
| (fluorine-based surfactant, manufactured by Asahi Glass Co., Ltd.) | |

A heat sensitive recording material was produced in the same manner as in Example 1 except that the composition of the coating solution for a protective layer was changed as described above.

Example 3

Preparation of a coating solution of a protective layer

| | |
|---|---|
| RS 110 (7% by weight) | 100 g |
| (PVA derivative, manufactured by Kuraray Co., Ltd.) | |
| Water | 25.7 g |
| Treated material of X-22-8053 | |
| (40% by weight IPA solution) | 52.6 g |

-continued

| | |
|---|---|
| (manufactured by Shin-Etsu Silicone Co., Ltd.) | |
| Surfactant 1 (2% by weight) | 10 ml |
| Surfactant 2 (5% by weight) | 10 ml |
| Surflon S131 (30% by weight) | 1.5 g |
| (fluorine-based surfactant, manufactured by Asahi Glass Co., Ltd.) | |

Treated material of X-22-8053 (40% by weight IPA solution) (manufactured by Shin-Etsu Silicone Co., Ltd.) was prepared by adding 190 g of X-22-8053 (40% by weight IPA solution) to an aqueous solution containing 304 g of water and 2.3 g of the surfactant 1, stirring the mixture at 105° C. for 5 hours to remove IPA, and further adding water to adjust the solid component concentration so as to be 20% by weight.

A heat sensitive recording material was produced in the same manner as in Example 2 except that the composition of the coating solution for a protective layer was changed as described above.

Example 4

A heat sensitive recording material was produced in the same manner as in Example 2 except that the 26.3 g of X-22-8053 (40% by weight IPA solution) in Example 2 was changed to 35.0 g of US 450 (manufactured by Toagosei Co., Ltd., 30% by weight aqueous solution of silicone graft acrylic polymer).

Example 5

A heat sensitive recording material was produced in the same manner as in Example 2 except that the 26.3 g of X-22-8053 (40% by weight IPA solution) in Example 2 was changed to 23.3 g of US 450 (manufactured by Toagosei Co., Ltd., 30% by weight aqueous solution of silicone graft acrylic polymer).

Comparative Example 1

Preparation of a coating solution of a protective layer

| | |
|---|---|
| RS 106 (10% by weight) | 100 g |
| (PVA derivative, manufactured by Kuraray Co., Ltd.) | |
| Water | 0.9 g |
| Surfactant 1 (2% by weight) | 10 ml |
| Surfactant 2 (5% by weight) | 5 ml |
| ME313 (3% by weight) | 20.0 g |
| (Fluorine oil, manufactured by Daikin Industries Ltd.) | |
| Surflon S131 (30% by weight) | 1.1 g |
| (fluorine-based surfactant, manufactured by Asahi Glass Co., Ltd.) | |
| Zinc stearate (20.5% by weight) | 5.0 g |

A heat sensitive recording material was produced in the same manner as in Example 1 except that the composition of the coating solution for a protective layer was changed as described above.

Each of the heat sensitive recording materials obtained in Examples 1 to 5 and Comparative Example 1 was subjected to printing using a thermal head KST, manufactured by Kyocera Corp., with the electric power to be applied to the thermal head and the pulse width set so that the recording energy per unit area was 62 mJ/$mm^2$, and magenta colors were formed on the heat sensitive recording materials upon printing. Then heat sensitive recording materials were then fixed by being exposed to an ultraviolet lamp having an illumination center wavelength of 365 nm and an output of 40 W for 15 seconds.

Evaluation method

Paper feeding: Continuous printing of 500 sheets of paper was conducted using a video/digital printer "NC-5" manufactured by Fuji Photo Film Co., Ltd. The number of times paper feeding failures such as the simultaneous feeding of a plurality of sheets of paper together occurred was counted (a smaller number indicates a better result).

Gloss: This was measured at an incident angle of 75° by a digital variable angle gloss meter UGV-5D manufactured by Suga Test Machine Corp (a larger number indicates a better result).

Method for measuring printing torque: An A4 size sample was transported in a longitudinal direction using a platen roll having a rubber hardness of 60 degrees and a length of 30 cm and a thermal head having a length of 30 cm, at a head pressure of 7 kg/cm, and gradation printing from Dmin to Dmax was effected. During this procedure, the torque of the platen roll was measured, and the friction between the head and the heat sensitive recording material in printing was evaluated at the maximum value of the printing torque.

The evaluation results are shown below.

| | Paper feeding failure | Gloss | | |
|---|---|---|---|---|
| | Number of occurrence | Unprinted part | Printed part | Printing torque |
| Example 1 | 0 | 70% | 85% | 6.0 kg.cm |
| Example 2 | 0 | 65% | 81% | 4.8 kg.cm |
| Example 3 | 0 | 68% | 83% | 4.5 kg.cm |
| Example 4 | 0 | 72% | 86% | 3.6 kg.cm |
| Example 5 | 0 | 75% | 87% | 3.9 kg.cm |
| Comparative Example 1 | 4 | 60% | 72% | 12.5 kg.cm |

The paper feeding of the heat sensitive recording materials of Examples was better as compared with Comparative Example as all the paper was fed without problems. Gloss was also good, and friction resistance was excellent as friction with the heat sensitive head in printing was advantageously low. (If the friction with the head during printing is high, noise during printing as well as printing displacement occur).

As described above, according to the present invention, there can be provided a heat sensitive recording material comprising a protective layer which is excellent in transparency, gloss, heat resistance, and light fastness and simultaneously excellent in sliding properties and lubricating properties, which does not cause adhesion and trash deposition on a thermal head and the like and provides excellent color-developed image.

What is clamed is:

1. A heat sensitive recording material comprising a substrate having a heat sensitive recording layer and a protective layer provided sequentially thereon, wherein said protective layer is formed using at least an aqueous silicone modified polymer which is a silicone graft polymer or a silicone block polymer, and said heat sensitive recording layer comprises at least one heat sensitive color developing layer mainly comprising a diazo compound, a coupler which effects a coupling reaction with the diazo compound, and a binder.

2. A heat sensitive recording material according to claim 1, wherein said protective layer is formed using at least an aqueous silicone modified polymer and an aqueous binder.

3. A heat sensitive recording material according to claim 1, wherein said protective layer is formed using at least an aqueous silicone modified polymer, an aqueous binder, and a crosslinking agent which can effect a crosslinking reaction with the aqueous silicone modified polymer and/or aqueous binder.

4. A heat sensitive recording material according to claim 3, wherein said aqueous silicone modified polymer and/or aqueous binder comprises as a functional group at least one functional group selected from the group consisting of a carboxyl group (or salt thereof), an amino group, an ammonium salt group, a hydroxyl group, a sulfinic acid group (or salt thereof), a sulfonic acid group (or salt thereof), and a glycidyl group.

5. A heat sensitive recording material according to claim 1, wherein said silicone modified polymer is a silicone graft polymer.

6. A heat sensitive recording material according to claim 1, wherein said silicone modified polymer is a silicone block polymer.

7. A heat sensitive recording material according to claim 1, wherein said silicone modified polymer is a polymer having repeating units represented by the general formula (1) and general formula (2);

General formula (1)

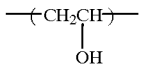

General formula (2)

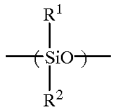

wherein, $R^1$ and $R^2$ each represents an alkyl group having 6 or less carbon atoms or an aryl group.

8. A heat sensitive recording material according to claim 1, wherein said silicone modified polymer comprises a polymer having a repeating unit represented by the general formula (1) and a repeating unit obtained by polymerization of a compound represented by the following general formula (3).

General formula (3)

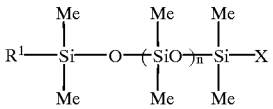

$R^1$: alkyl group having 1 to 6 carbon atoms

X: $CH{=}CH_2$,

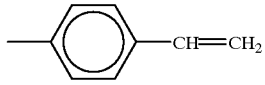

$(CH_2)_mOC(=O)CH{=}CH_2$, $(CH_2)_mOC(=O)C(CH_3){=}CH_2$ m: 2 to 6 n: positive integer.

9. A heat sensitive recording material according to claim 1, wherein said silicone modified polymer comprises a copolymer composed of a silicone macro monomer represented by the general formula (3) described above and a monomer copolymerizable with the macro monomer.

10. A heat sensitive recording material according to claim 1, wherein said heat sensitive recording layer comprises a diazo compound and a coupler, and said diazo compound is encapsulated in a microcapsule.

11. A heat sensitive recording material according to claim 1, wherein said heat sensitive recording layer comprises a heat sensitive recording layer containing an electron donative dye precursor and an electron acceptive compound, and at least one heat sensitive recording layer containing a diazonium salt compound and a coupler which develops color by reacting with the diazonium salt compound.

12. A heat sensitive recording material according to claim 11, wherein said heat sensitive recording layer comprises a heat sensitive recording layer containing a diazonium salt compound of which the maximum absorption wavelength is less than 340 nm and a coupler which develops color by reacting with the diazonium salt compound, a heat sensitive recording layer containing a diazonium salt compound of which the maximum absorption wavelength is 360±20 nm and a coupler which develops color by reacting with the diazonium salt compound and a heat sensitive recording layer containing a diazonium salt compound of which the maximum absorption wavelength is 400±20 nm and a coupler which develops color by reacting with the diazonium salt compound.

13. A heat sensitive recording material according to claim 12, wherein a light transmittance controlling layer, of which the light transmittance within the wavelength range for photo-fixing decreases after fixation, is provided on said heat sensitive recording layer.

14. A heat sensitive recording material according to claim 1, wherein said protective layer contains a silicone modified polymer having a Tg (glass transition point) of 60° C. or more.

15. A heat sensitive recording material according to claim 14, wherein said protective layer contains a silicone modified polymer having a Tg (glass transition point) of 60° C. or more and an aqueous binder.

16. A heat sensitive recording material according to claim 15, wherein said protective layer contains a silicone modified polymer having a Tg (glass transition point) of 100° C. or more and an aqueous binder.

17. A heat sensitive recording material according to claim 16, wherein said aqueous binder is a water-soluble polymer.

18. A heat sensitive recording material according to claim 17, wherein said water-soluble polymer is an aqueous polymer which can be set-dried, and composed of at least one selected from the group consisting of gelatin or derivative thereof, K-carageenan, and polyvinyl alcohol or derivative thereof.

19. A heat sensitive recording material according to claim 18, wherein said protective layer is formed by using at least an aqueous silicone modified polymer and polyvinyl alcohol or ethylene modified polyvinyl alcohol represented by the following structural formula, and boric acid or salt thereof;

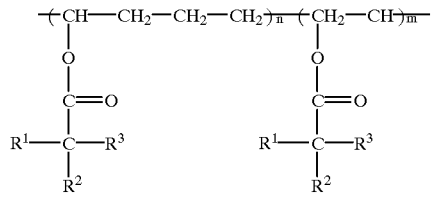

wherein, $R^1$, $R^2$, and $R^3$ represent a hydrogen atom or a hydrocarbon group, $R^2$ and $R^3$ may bond with each other to form a cyclic hydrocarbon group, or $R^1$, $R^2$, and $R^3$ may bond with each other to form a cyclic hydrocarbon group.

* * * * *